US007840152B2

(12) United States Patent
Koichi et al.

(10) Patent No.: US 7,840,152 B2
(45) Date of Patent: Nov. 23, 2010

(54) IMAGE FORMING APPARATUS, PROCESS CARTRIDGE, CLEANING SYSTEM, AND IMAGE FORMING APPARATUS WITH CLEANING SYSTEM

(75) Inventors: Yasushi Koichi, Kanagawa (JP); Koji Suzuki, Kanagawa (JP); Shigekazu Enoki, Kanagawa (JP); Osamu Ariizumi, Kanagawa (JP); Kumiko Hatakeyama, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/348,094

(22) Filed: Jan. 2, 2009

(65) Prior Publication Data

US 2009/0116863 A1 May 7, 2009

Related U.S. Application Data

(62) Division of application No. 11/018,760, filed on Dec. 22, 2004, now Pat. No. 7,499,664.

(30) Foreign Application Priority Data

| | | |
|---|---|---|
| Dec. 22, 2003 | (JP) | 2003-425406 |
| Dec. 22, 2003 | (JP) | 2003-425417 |
| Dec. 26, 2003 | (JP) | 2003-434907 |
| Feb. 20, 2004 | (JP) | 2004-043780 |
| Feb. 20, 2004 | (JP) | 2004-043782 |

(51) Int. Cl.
*G03G 15/00* (2006.01)

(52) U.S. Cl. ..... 399/71; 399/149; 430/122.4

(58) Field of Classification Search ..... 399/71
See application file for complete search history.

(56) References Cited

U.S. PATENT DOCUMENTS

| | | | | |
|---|---|---|---|---|
| 4,885,466 | A | | 12/1989 | Koichi et al. |
| 4,885,612 | A | | 12/1989 | Satoh et al. |
| 4,962,394 | A | | 10/1990 | Sohmiya et al. |
| 5,006,896 | A | | 4/1991 | Koichi et al. |
| 5,038,175 | A | | 8/1991 | Sohmiya et al. |
| 5,049,939 | A | | 9/1991 | Koichi |
| 5,200,780 | A | | 4/1993 | Koichi |
| 5,318,873 | A | * | 6/1994 | Kawamura et al. ..... 430/122.4 |
| 5,327,196 | A | | 7/1994 | Kato et al. |
| 5,387,965 | A | | 2/1995 | Hasegawa et al. |
| 5,400,127 | A | | 3/1995 | Arai et al. |

(Continued)

FOREIGN PATENT DOCUMENTS

| | | |
|---|---|---|
| JP | 58-114073 | 7/1983 |

(Continued)

*Primary Examiner*—David M Gray
*Assistant Examiner*—Roy Yi
(74) *Attorney, Agent, or Firm*—Oblon, Spivak, McClelland, Maier & Neustadt, L.L.P.

(57) ABSTRACT

A transfer residual toner that has not been electrostatically transferred onto a transfer paper P at a transfer nip and remains on a surface of a photosensitive element is temporarily retained by an elastic blade of a toner retaining unit in a mechanical manner before reaching a latent image forming area. When passing through the latent image forming area, the transfer residual toner is returned onto the surface of the photosensitive member at such a timing that writing is not performed by an exposing unit on the surface of the photosensitive element.

12 Claims, 12 Drawing Sheets

U.S. PATENT DOCUMENTS

| | | | | |
|---|---|---|---|---|
| 5,508,787 | A | 4/1996 | Hasegawa et al. | |
| 6,029,033 | A * | 2/2000 | Kawasaki | 399/149 |
| 6,064,124 | A | 5/2000 | Inukai | |
| 6,449,448 | B2 | 9/2002 | Bessho et al. | |
| 6,697,584 | B2 | 2/2004 | Tsunoda et al. | |
| 6,792,229 | B2 | 9/2004 | Matsuzaki | |
| 6,823,155 | B2 | 11/2004 | Tsuda et al. | |

FOREIGN PATENT DOCUMENTS

| | | |
|---|---|---|
| JP | 63-197982 | 8/1988 |
| JP | 2-267581 | 11/1990 |
| JP | 4-55880 | 2/1992 |
| JP | 9-197944 | 7/1997 |
| JP | 9-212057 | 8/1997 |
| JP | 11-202523 | 7/1999 |
| JP | 11-249518 | 9/1999 |
| JP | 3091323 | 7/2000 |
| JP | 2001-042732 | 2/2001 |
| JP | 2001-066854 | 3/2001 |
| JP | 2001-350326 | 12/2001 |
| JP | 2003-323049 | 11/2003 |
| JP | 2004-93849 | 3/2004 |

* cited by examiner

IMAGE FORMING APPARATUS, PROCESS CARTRIDGE, CLEANING SYSTEM, AND IMAGE FORMING APPARATUS WITH CLEANING SYSTEM

CROSS-REFERENCE TO RELATED APPLICATIONS

This application is a divisional of and is based upon and claims the benefit of priority under 35 U.S.C. §120 for U.S. Ser. No. 11/018,760, filed Dec. 22, 2004, and claims the benefit of priority under 35 U.S.C. §119 from Japanese Patent Application Nos. 2003-425406, filed Dec. 22, 2003, 2003-425417, filed Dec. 22, 2003, 2003-434907, filed Dec. 26, 2003, 2004-043780, filed Feb. 20, 2004, 2004-043782, filed Feb. 20, 2004, the entire contents of each which are incorporated herein by reference.

BACKGROUND OF THE INVENTION

1) Field of the Invention

The present invention relates to an image forming apparatus without a cleaning system, a process cartridge, a cleaning system, and an image forming apparatus that includes the cleaning system.

2) Description of the Related Art

An electrostatic transfer scheme is employed in some kinds of image forming apparatuses to transfer a toner image on a latent image carrier to a transferee. In the electrostatic transfer scheme, a transfer electric field is formed between the latent image carrier and the transferee that moves on a surface of the latent image carrier keeping a contact with the surface. In such apparatuses, a transfer residual toner remains on a portion of the surface of the latent image carrier after transferring the toner image. If the latent image carrier is used in a next image forming step with the transfer residual toner left unremoved on the portion, a charge failure, such as a nonuniform charge, occurs on that portion, causing image deterioration. Therefore, conventionally, a cleaning apparatus is provided at a position opposed to the surface of latent image carrier from a transfer area to a charging area to remove the transfer residual toner. Such a cleaning apparatus requires a space for installing a waste toner tank for storing the transfer residual toner collected from the surface of the latent image carrier, a recycle toner conveyor passage for conveying the transfer residual toner for recycling the collected transfer residual toner, and the like. This increases the size of the image forming apparatus.

To get around the problem of increasing the size of the apparatus, an image forming apparatus disclosed in Japanese Patent No. 3091323 (hereinafter, a patent document) has been devised, for example. This image forming apparatus adopts a scheme of collecting a transfer residual toner remaining on the surface of the latent image carrier by using a developing device (hereinafter, "developer collecting scheme"). In this developer collecting scheme, the developing device, which is provided for a purpose different from cleaning, is used for collecting a transfer residual toner. Therefore, no waste toner tank or recycle toner conveyer passage as described above is required to be separately provided. Thus, using such a developer collecting scheme can contribute to downsizing of the image forming apparatus.

Also, the patent document describes an example in which a charging device included in the image forming apparatus using the developer collecting scheme performs charging by making a charging roller in contact with the latent image carrier. Conventionally known schemes of uniformly charging the surface of the latent image carrier include a contact/proximity charging scheme in which the surface is uniformly charged by making a charging member, such as a charging roller, in contact with the surface, and a charger charging scheme for uniform charging with a corona charger. However, in the charger charging scheme, to cause the surface of the latent image carrier to have a desired potential, a large amount of discharge has to be generated. Therefore, a large amount of discharge products, such as ozone or nitrogen oxide, are generated, thereby causing a possible environmental problem. On the other hand, in the contact/proximity charging scheme, the amount of discharge is small compared with that in the charger charging scheme, and therefore this scheme is advantageous in view of environment. Therefore, according to the image forming apparatus disclosed in the example described above, the size of the apparatus can be made small, and also the amount of discharge products is small, thereby achieving a possible advantageous effect in view of environment.

However, in an image forming apparatus using both of the charger collecting scheme and the contact/proximity charging scheme, when the transfer residual toner on the latent image carrier is conveyed to a developing area, the transfer residual toner and the charging member may come in contact with or be proximity to each other. Therefore, the transfer residual toner may adhere to the charging member. The transfer residual toner adhering to the charging member may prevent uniform charging, thereby making it impossible to cause the surface potential of the latent image carrier at a desired potential and causing an insufficient charge, such as uneven charge. As a result, degradation in image density and background stain occur, thereby causing a problem of degradation in image quality. This problem does not restrictively occur when the developer collecting scheme is adopted, but also occurs as long as the apparatus has a structure in which a transfer residual toner is left unremoved from the latent image carrier and is conveyed to an area in contact with the charging member.

The Inventors have suggested the following apparatus (hereinafter, a first image forming apparatus) as an image forming apparatus that can solve the problem described above. In the first image forming apparatus, of the transfer residual toner remaining on the surface of the latent image carrier after transfer, a reversely-charged toner having a polarity reverse to a normally-charged toner charged with the same polarity as that of a charging bias is collected by a temporarily-retaining unit, such as a brush member, from the surface of the latent image carrier for retaining. As such, by collecting and retaining the reversely-charged toner, the reversely-charged toner can be prevented from adhering to the charging member. Then, the retained reversely-charged toner is returned to the surface of the latent image carrier at a predetermined timing, such as during a period starting from the completion of formation of an image until formation of the next image. Then, the reversely-charged toner returned on the surface of the latent image carrier is collected by a developing device or is transferred to a transferee or a conveying member for conveying the reversely-charged toner. According to the first image forming apparatus, while the returned reversely-charged toner is passing through the charged area, application of the charging bias is stopped or the charging member is separated from the latent image carrier. Therefore, the reversely-charged toner is prevented from adhering to the charging member.

The Inventors have also suggested the following apparatus (hereinafter, a second image forming apparatus) as an image forming apparatus that can solve the problem described above. In the second image forming apparatus, of the transfer residual toner remaining on the surface of the latent image carrier after transfer, a transfer residual toner having a polarity reverse to the polarity of a charging bias is collected and retained by a temporarily-retaining unit, such as a fur brush, from the surface of the latent image carrier for retaining. As such, by collecting and retaining the transfer residual toner having a polarity reverse to the polarity of the charging bias, the transfer residual toner can be prevented from adhering to the charging member. Then, the retained transfer residual toner having a polarity reverse to the polarity of the charging bias is returned to the surface of the latent image carrier at a predetermined timing, such as during a period starting from the completion of formation of an image until formation of the next image. Then, the transfer residual toner returned on the surface of the latent image carrier is collected by a developing device or is transferred to a transferee or a conveying member for conveying the transfer residual toner. According to the second image forming apparatus, while the returned toner is passing through the charged area, application of the charging bias is stopped or the charging member is separated from the latent image carrier. Therefore, the transfer residual toner having a polarity reverse to the polarity of the charging bias is prevented from adhering to the charging member.

However, in the first image forming apparatus, a normally-charged toner of the transfer residual toner is not collected by the temporarily-retaining unit, such as a brush member. Therefore, the normally-charged toner may pass through an area opposed to the latent image forming unit (hereinafter, a latent image forming area) during the step of forming of the next image to be collected by the developing device or be transferred to the transferee. Therefore, with the normally-charged toner adhering to the surface of the latent image carrier, a latent image is formed by the latent image forming unit on the surface of the latent image carrier. Thus, a portion where the toner adheres and a portion shadowed by the toner are not exposed, thereby posing a problem of occurrence of white dots on a solid image portion.

Similarly, in the second image forming apparatus, a toner having the same polarity as the polarity of the charging bias is not collected by the temporarily-retaining unit, such as a fur brush. Therefore, the uncollected toner may pass through the latent image forming area during the step of forming of the next image to be collected by the developing device or be transferred to the transferee. Therefore, with the transfer residual toner adhering to the surface of the latent image carrier, a latent image is formed by the latent image forming unit on the surface of the latent image carrier. Thus, a portion where the toner adheres and a portion shadowed by the toner are not exposed, thereby posing a problem of occurrence of white dots on a solid image portion.

SUMMARY OF THE INVENTION

It is an object of the present invention to solve at least the above problems in the conventional technology.

An image forming apparatus according to one aspect of the present invention includes a latent image carrier; a charging unit that includes a charging member to which a charging bias of a predetermined polarity is applied, and that uniformly charges a surface of the latent image carrier; a latent image forming unit that forms a latent image on the surface of the latent image carrier that is uniformly charged; a developing unit that develops the latent image into a toner image by applying a toner that is charged to a polarity same as the predetermined polarity on the latent image; a transferring unit that transfers the toner image, by forming a transfer electric field between the latent image carrier and a surface moving member that moves on the latent image carrier keeping a contact with the surface of the latent image carrier, to any one of a recording member and the surface moving member, the recording member arranged between the transferring unit and the surface moving member; a temporarily-retaining unit that temporarily and mechanically retains a residual toner, which remains on the surface of the latent image carrier after the transferring unit transfers the toner image, by abutting on the latent image carrier while the residual toner travels from the transferring unit to the latent image forming unit; and a controlling unit that at a predetermined timing controls to return the residual toner retained by the temporarily-retaining unit to the surface of the latent image carrier.

A process cartridge according to another aspect of the present invention is arranged in an image forming apparatus according to the above aspect. The latent image carrier and at least one of the charging unit and the developing unit are integrated in the process cartridge, and the process cartridge is detachable.

An image forming apparatus according to still another aspect of the present invention includes a latent image carrier; a charging unit that includes a charging member to which a charging bias of a predetermined polarity is applied, and that uniformly charges a surface of the latent image carrier; a latent image forming unit that forms a latent image on the surface of the latent image carrier that is uniformly charged; a developing unit that develops the latent image into a toner image by applying a toner that is charged to a polarity same as the predetermined polarity on the latent image; a transferring unit that transfers the toner image, by forming a transfer electric field between the latent image carrier and a surface moving member that moves on the latent image carrier keeping a contact with the surface of the latent image carrier, to any one of a recording member and the surface moving member, the recording member arranged between the transferring unit and the surface moving member; a temporarily-retaining unit that temporarily and mechanically retains a residual toner, which remains on the surface of the latent image carrier after the transferring unit transfers the toner image, by abutting on the latent image carrier while the residual toner travels from the transferring unit to the latent image forming unit; and a controlling unit that at a predetermined timing controls to return the residual toner retained by the temporarily-retaining unit to the surface of the latent image carrier A toner resistance of the toner is equal to or smaller than $1\times10^9$ ohm centimeters, an average-weight particle diameter of the toner is equal to or larger than 5.0 micrometers and equal to or smaller than 10.0 micrometers, and an average peround of the toner is equal to or larger than 0.85.

A process cartridge according to still another aspect of the present invention is arranged in an image forming apparatus according to the above aspect, and a toner resistance of the toner is equal to or smaller than $1\times10^9$ ohm centimeters, an average-weight particle diameter of the toner is equal to or larger than 5.0 micrometers and equal to or smaller than 10.0 micrometers, and an average peround of the toner is equal to or larger than 0.85 in the image forming apparatus. The latent image carrier and at least one of the charging unit and the developing unit are integrated in the process cartridge, and the process cartridge is detachable.

An image forming apparatus according to still another aspect of the present invention includes a latent image carrier; a charging unit that includes a charging member to which a charging bias of a predetermined polarity is applied, and that uniformly charges a surface of the latent image carrier; a latent image forming unit that forms a latent image on the surface of the latent image carrier that is uniformly charged; a developing unit that develops the latent image into a toner image by applying a toner that is charged to a polarity same as the predetermined polarity on the latent image; a transferring unit that transfers the toner image, by forming a transfer electric field between the latent image carrier and a surface moving member that moves on the latent image carrier keeping a contact with the surface of the latent image carrier, to any one of a recording member and the surface moving member, the recording member arranged between the transferring unit and the surface moving member; a temporarily-retaining unit that temporarily and mechanically retains a residual toner, which remains on the surface of the latent image carrier after the transferring unit transfers the toner image, by abutting on the latent image carrier while the residual toner travels from the transferring unit to the latent image forming unit; and a controlling unit that at a predetermined timing controls to return the residual toner retained by the temporarily-retaining unit to the surface of the latent image carrier.

A process cartridge according to still another aspect of the present invention is arranged in an image forming apparatus according to the above aspect, and the latent image carrier and at least one of the charging unit and the developing unit are integrated in the process cartridge, and the process cartridge is detachable.

A cleaning system according to still another aspect of the present invention collects a residual toner that remains on a surface of a latent image carrier after transferring, to a surface moving member, a toner image that is formed by uniformly charging the surface of the latent image carrier by a charging unit, by forming a latent image by a latent image forming unit on the surface of the latent image carrier, and by developing the latent image to a toner image by a developing unit. The cleaning system includes a temporarily-retaining unit that includes a rotating member that includes a magnetic field generating unit and that carries a magnetic particle as a magnetic brush on a surface of the rotating member, and that temporarily and mechanically retains the residual toner, by abutting on the latent image carrier while the residual toner travels from the transferring unit to the latent image forming unit; and a controlling unit that at a predetermined timing controls to return the residual toner retained by the temporarily-retaining unit to the surface of the latent image carrier.

A process cartridge according to still another aspect of the present invention includes a latent image carrier and at least a charging unit among a developing unit that forms a toner image on a surface of the latent image carrier and the charging unit that uniformly charges the surface of the latent image carrier that are integrated, is detachably arranged in a main body of an apparatus. The process cartridge includes a cleaning system according to the above aspect, and the cleaning system is used as a cleaning unit that removes the residual toner remained on the surface of the latent image carrier.

An image forming apparatus according to still another aspect of the present invention includes a latent image carrier;

a charging unit that uniformly charges a surface of the latent image carrier; a latent image forming unit that forms a latent image on the surface uniformly charged; a developing unit that develops the latent image into a toner image by applying a toner that is charged to a polarity same as the predetermined polarity on the latent image; a transferring unit that transfers the toner image, by forming a transfer electric field between the latent image carrier and a surface moving member that moves on the latent image carrier keeping a contact with the surface of the latent image carrier, to the surface moving member; and a process cartridge according to the above aspect.

An image forming apparatus according to still another aspect of poi includes a latent image carrier; a charging unit that uniformly charges a surface of the latent image carrier; a latent image forming unit that forms a latent image on the surface of the latent image carrier that is uniformly charged; a developing unit that develops the latent image into a toner image by applying a toner that is charged to a polarity same as the predetermined polarity on the latent image; and a transferring unit that transfers the toner image, by forming a transfer electric field between the latent image carrier and a surface moving member that moves on the latent image carrier keeping a contact with the surface of the latent image carrier, to any one of a recording member and the surface moving member, the recording member arranged between the transferring unit and the surface moving member. A cleaning system according to the above aspect is used as a cleaning unit that removes the residual toner remaining on the surface of the latent image carrier after the toner image is transferred to the surface moving member.

A cleaning system according to still another aspect of the present invention collects a residual toner that remains on a surface of a latent image carrier after transferring, to a surface moving member, a toner image that is formed by uniformly charging the surface of the latent image carrier by a charging unit, by forming a latent image by a latent image forming unit on the surface of the latent image carrier, and by developing the latent image to a toner image by a developing unit. The cleaning system includes a temporarily-retaining unit that includes a rotating member that includes a magnetic field generating unit and that carries a plurality of types of magnetic particles having different distribution of a particle diameter as a magnetic brush on a surface of the rotating member, and that temporarily retains the residual toner with the magnetic brush by sliding the magnetic brush keeping a contact with the surface of the latent image carrier while the residual toner travels from the transferring unit to the charging unit; and a controlling unit that at a predetermined timing controls to return the residual toner retained by the temporarily-retaining unit to the surface of the latent image carrier.

A process cartridge according to still another aspect of the present invention includes latent image carrier and at least a charging unit among a developing unit that forms a toner image on a surface of the latent image carrier and the charging unit that uniformly charges the surface of the latent image carrier that are integrated, and that is detachably arranged in a main body of an apparatus. The process cartridge includes a cleaning system according to the above aspect, and the cleaning system is used as a cleaning unit that removes the residual toner remained on the surface of the latent image carrier.

An image forming apparatus according to still another aspect of the present invention includes a latent image carrier; a charging unit that uniformly charges a surface of the latent image carrier; a latent image forming unit that forms a latent image on the surface uniformly charged; a developing unit that develops the latent image into a toner image by applying to the latent image a toner that is charged to a polarity same as the predetermined polarity on the latent image; a transferring unit that transfers the toner image, by forming a transfer electric field between the latent image carrier and a surface moving member that moves on the latent image carrier keeping a contact with the surface of the latent image carrier, to the surface moving member; and a process cartridge according to the above aspect.

An image forming apparatus according to still another aspect of the present invention includes a latent image carrier; a charging unit that uniformly charges a surface of the latent image carrier; a latent image forming unit that forms a latent image on the surface uniformly charged; a developing unit that develops the latent image into a toner image by applying to the latent image a toner that is charged to a polarity same as the predetermined polarity on the latent image; a transferring unit that transfers the toner image, by forming a transfer electric field between the latent image carrier and a surface moving member that moves on the latent image carrier keeping a contact with the surface of the latent image carrier, to the surface moving member; and a cleaning system according to the above aspect. The cleaning system is used as a cleaning unit that removes the residual toner remained on the surface of the latent image carrier after the toner image is transferred to the surface moving member.

The other objects, features, and advantages of the present invention are specifically set forth in or will become apparent from the following detailed description of the invention when read in conjunction with the accompanying drawings.

DETAILED DESCRIPTION

Exemplary embodiments of an image forming apparatus without a cleaning system, a process cartridge, and an image forming apparatus that includes the cleaning system according to the present invention will be described in detail below with reference to the accompanying drawings.

Figure 1:
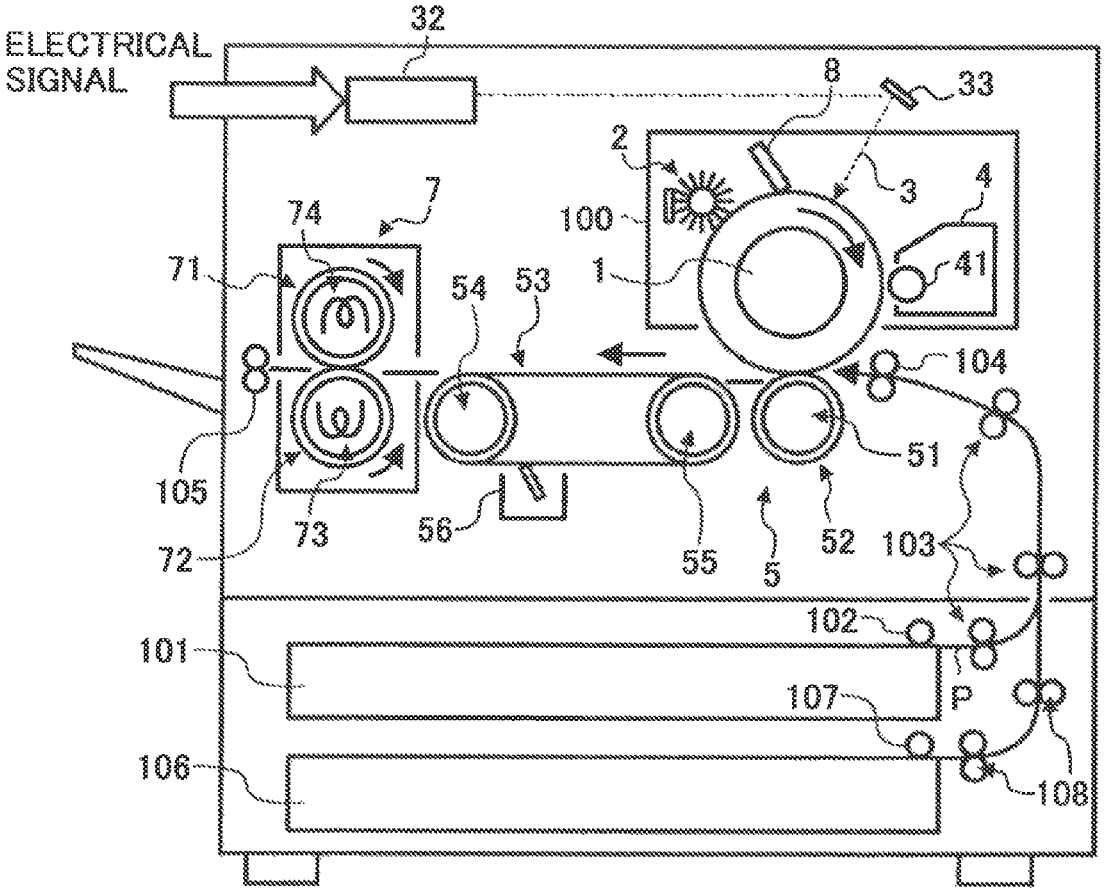
FIG. 1 is a schematic of an image forming apparatus according to a first embodiment of the present invention.

FIG. 1 is a schematic structural diagram of a printer according to a first embodiment. This printer includes a drum-shaped photosensitive member 1, which is a latent image carrier for carrying a latent image. As the photosensitive member 1, an existing photosensitive member, such as an organic photosensitive member or amorphous, can be used. In the first embodiment, in view of low cost, design flexibility, and non-pollution, an organic photosensitive member is used.

The surface of this photosensitive member 1 is uniformly charged by a charging device 2. The charging device 2 includes a charging roller 21 that performs a charging process with a so-called contact charging scheme. The charging roller 21 has a cored bar on which a foamed sponge layer, a conductive layer, and a protective layer for preventing the occurrence of leak are formed. The charging roller 21 is in contact with the surface of the photosensitive member. Applied with a negative bias from a power supply device not shown, the charging roller 21 uniformly charges the surface of the photosensitive member 1 at −500 volts.

Then, a scanning and exposing process is performed based on image information by a laser optical device 3 serving as an exposing unit to form an electrostatic latent image. The image information is represented by an image signal reflected on a mirror 33 after scanning with laser light by a polygon motor. In the first embodiment, the laser optical device 3 serves as an exposing unit. Alternatively, various types of exposing units can be used, such as an exposing device formed of an light-emitting diode (LED) array and an image forming unit.

The electrostatic latent image formed on the photosensitive member 1 is developed by a developing device 4 to become a toner image, and then is transferred by a transfer device 5 onto transfer paper P. The transfer device 5 includes a transfer roller 52 having a metal roller 51 with an intermediate-resistive gum layer, which is in contact with the photosensitive member 1 to form a transfer nip. The transfer roller 52 is applied with a positive transfer bias from a power supply device not shown, and the toner image on the photosensitive member 1 is electrostatically transferred to the transfer paper P. Also, the developing device 4 accommodates a so-called binary developer containing a toner and magnetic carrier not shown, and conveys the binary developer carried on a developing roller 41 to a position opposed to the photosensitive member 1 to develop an electrostatic latent image. The toner for use is a negative toner with negative charge.

The toner that will be consumed when the toner image is formed is supplied to the developing device 4 from a toner bottle not shown that can be removed from a printer device body. As such, since the toner bottle is structured so that it can be removed from the printer device body, when the toner runs out, all what is required is to replace the toner bottle. Therefore, other components that have not yet reached their end of life by the end of toner's life can be used as they are, thereby suppressing user's cost. As for a color printer, if a separate bottle is provided for each of yellow, cyan, magenta, and black, each toner bottle can be replaced separately, thereby suppressing user's cost.

The transfer device 5 is provided thereunder with a plurality of paper feeding cassettes 101 and 106 that are vertically stacked, each accommodating a plurality of pieces of transfer paper P, which are recording bodies, as being stacked on top of each other. These paper feeding cassettes 101 and 106 drive and rotate paper feeding rollers 102 and 107, respectively, being pressed onto the top transfer paper P at a predetermined timing to feed the transfer paper P to a paper conveying path. On the paper conveying path, the fed transfer paper P goes through a plurality of conveyor paired rollers 103, and then stops as being pinched between paired resist rollers 104. The paired resist rollers 104 convey the pinched transfer paper P to the transfer nip between the transfer roller 52 and the photosensitive member 1 at a timing when the toner image formed on the photosensitive member 1 in such a manner as described above can be overlaid on the transfer paper P. With this, the toner image on the photosensitive member 1 and the transfer paper P conveyed by the paired resist rollers 104 are brought into intimate contact with each other in synchronization at the transfer nip. Then, under the influence of the transfer bias described above, the image is electrostatically transferred onto the transfer paper P.

On the left of the transfer roller in the drawing, a paper conveyor belt 5 laid between two rollers 54 and 55 in a tensioned condition without being terminated moves counterclockwise in the drawing. Also, on further left of this paper conveyor belt 53, a fixing device 7 and paired paper delivery rollers 105 are provided in this order, in which a component closer to the paper conveyor belt 53 appears first. The transfer paper P having the toner image electrostatically transferred thereon is conveyed in accordance with the rotation of the photosensitive member 1 and the transfer roller 52 from the transfer nip to the paper conveyor belt 53, and then enters the fixing device 7. In this fixing device 7, a fixing roller 71 and a pressure roller 72 rotate with constant velocity while abutting on each other to form, as a pair, a fixing nip. Also, these fixing roller 71 and the pressure roller 72 have heat sources 73 and 74, respectively, such as halogen lamps, to control the fixing roller 71 and the pressure roller 72 at a predetermined temperature. The transfer paper P entering the fixing device 7 is pinched by the fixing nip to be subjected to a heating process and a pressing process. With this, the toner is hot-melted as being pressed, thereby causing the toner image to be fixed onto the transfer paper P. The transfer paper P then goes out from the fixing device 7 to the outside via the paired paper delivery rollers 105. In the first embodiment, since the heat source 73 is provided to the pressure roller 72, a toner fixing time can be reduced, and the printer speed can be increased.

A transfer residual toner not electrostatically transferred onto the transfer paper P to remain on the surface of the photosensitive member 1 is temporarily retained by the charging device 2 and a toner retaining unit 8, and is then again carried on the surface of the photosensitive member 1 to be collected by the developing device 4. Also, the transfer residual toner is removed by the transfer nip from the photosensitive member 1 and the paper conveyor belt 53.

In the first embodiment, the photosensitive drum 1, and the developing device 4, the charging device 2, the toner retaining unit 8, and others that surround the photosensitive member 1 are formed in a process cartridge 100. This process cartridge 100 is removable from a printer body. Therefore, if any component incorporated in the process cartridge 100 reaches its end of life or requires maintenance, all what is required is to replace the process cartridge 100. This improves convenience.

Figure 2A:
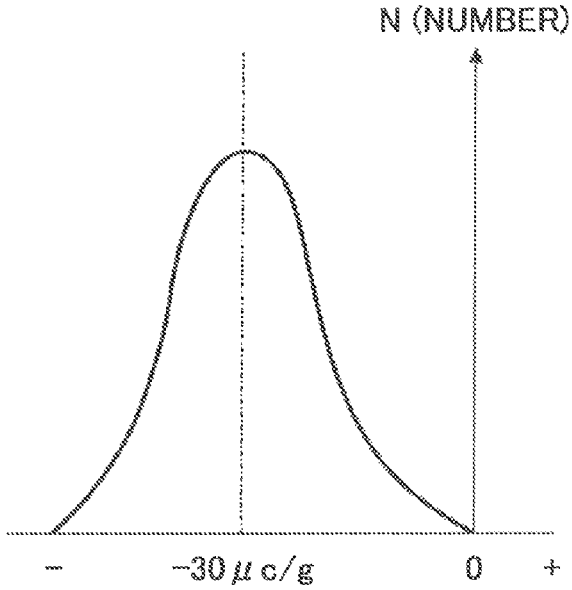
FIG. 2A is a graph of charge potential distribution before transfer of a toner carried on a photosensitive drum of the image forming apparatus.
Figure 2B:
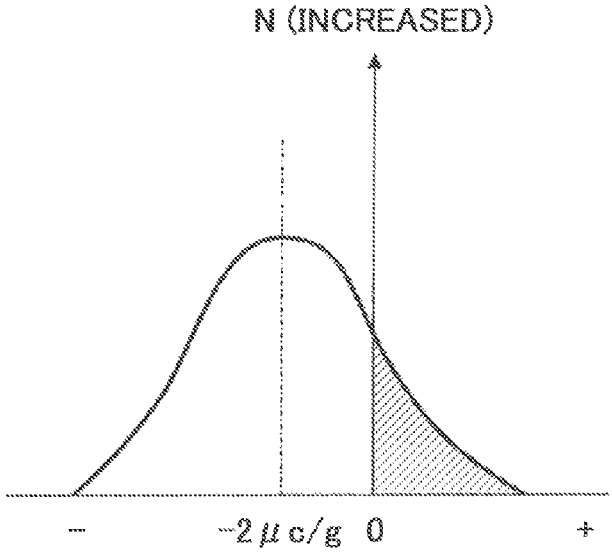
FIG. 2B is a graph of charge potential distribution of a transfer residual toner remaining on the photosensitive drum after transfer.

FIG. 2A is a graph of charge potential distribution immediately before transfer of the toner carried on the photosensitive drum 1. FIG. 2B is a graph of charge potential distribution of a transfer residual toner remaining on the photosensitive drum 1 after transfer. As shown in FIG. 2A, the amount of charge of the toner immediately before transfer is distributed centering on approximately −30 μC/g, and most of the toner has a normal negative charge. On the other hand, the amount of charge of the transfer residual toner is distributed centering on −2 μC/g. In general, most of the transfer residual toner does not have a desired charge because of, for example, receiving a charge injection of a positive bias applied to a primary transfer roller 14. As a result, the transfer residual toner includes a reversely-charged toner, as shown in a diagonally-shaded area of FIG. 2B, with its polarity being reversed to positive.

The transfer residual toner mixed with the reversely-charged toner with its polarity being reversed to positive as described above is conveyed, as adhering to the surface of the photosensitive member, to a position opposed to the charging roller 21 of the charging device 2. At the opposing position, a direct-current charging bias is applied from a power supply device 22 to the charging roller 21 so that the surface potential of the photosensitive member 1 is uniformly at −500 volts. At this time, of the transfer residual toner, the toner having the polarity being reversed to positive is electrostatically absorbed on the charging roller 21. On the other hand, since the toner having a negative polarity is the same in polarity as the charging bias, the toner passes without adhering to the charging roller 21 to be retained by the toner retaining unit 8 serving as a temporarily retaining unit.

Figure 3:
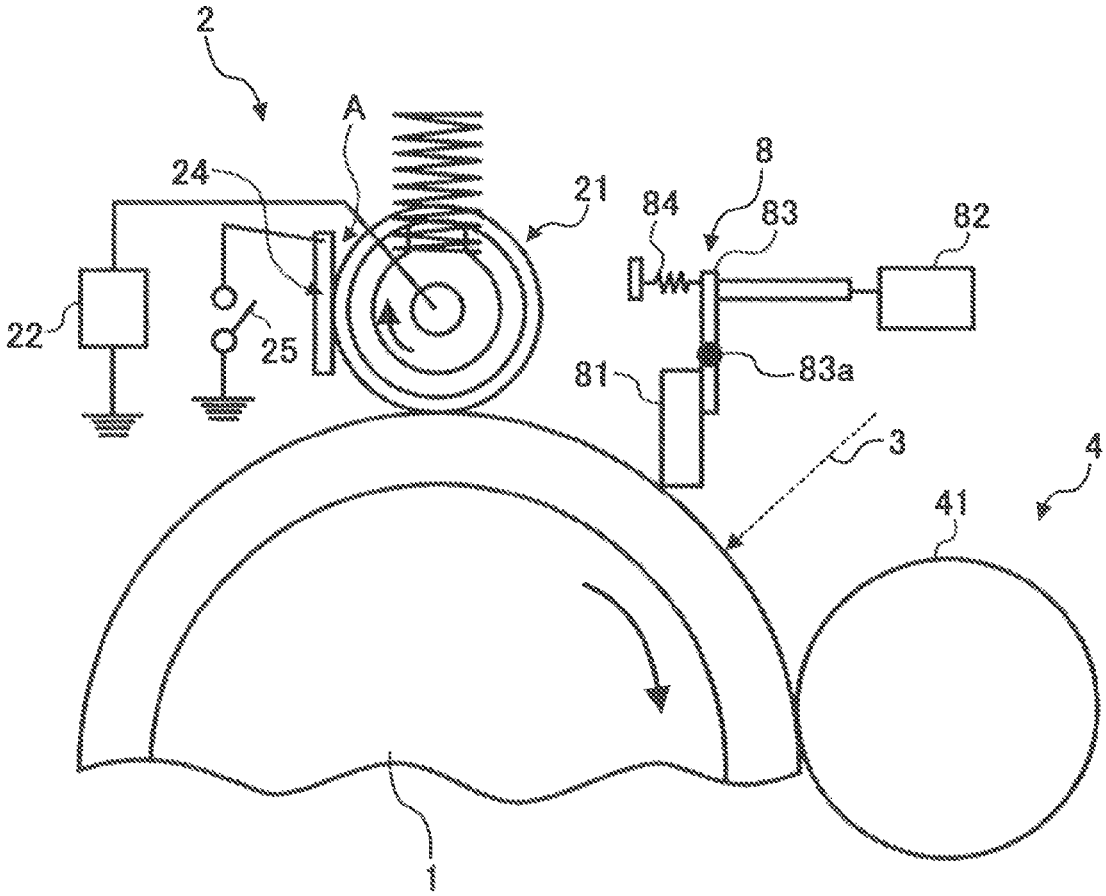
FIG. 3 is a schematic of a photosensitive member.
Figure 4:
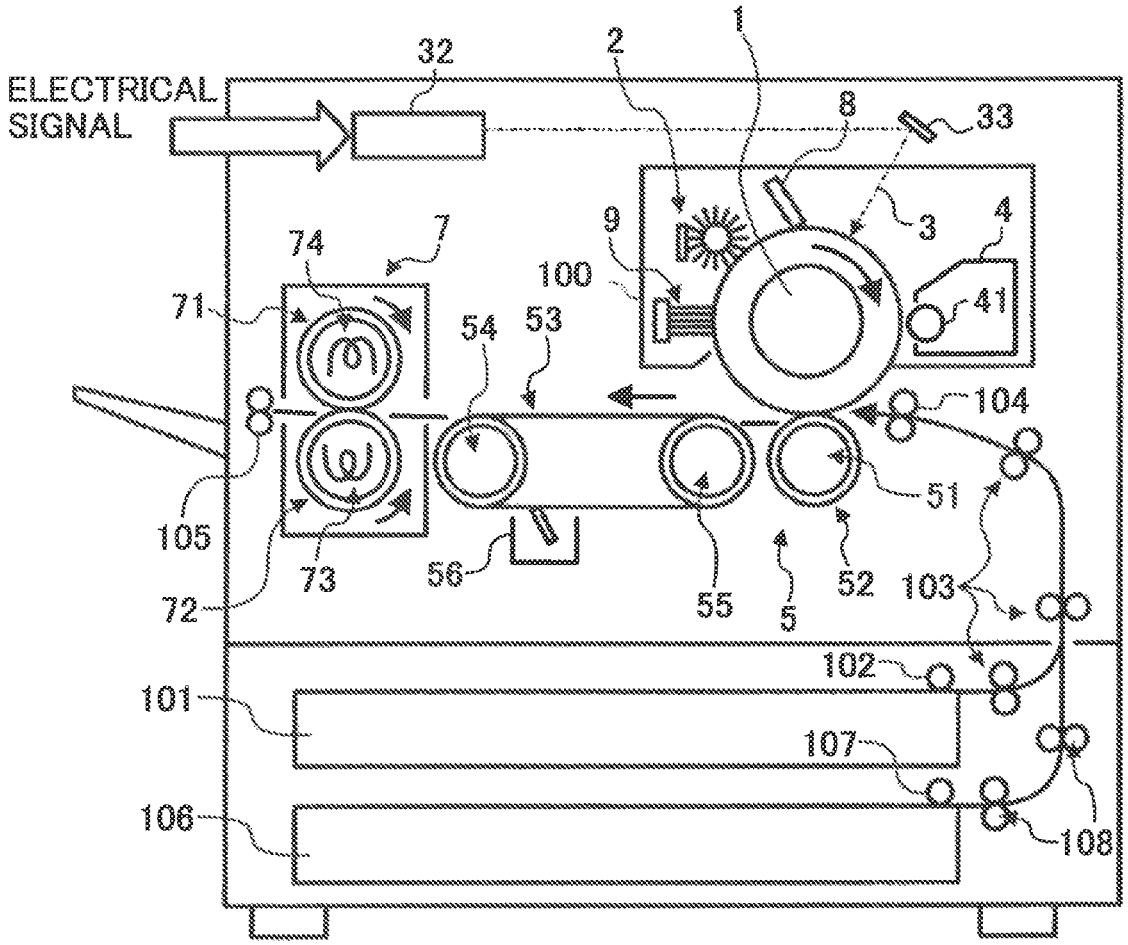
FIG. 4 is a schematic of an image forming apparatus according to a modification of the present invention.
Figure 5:
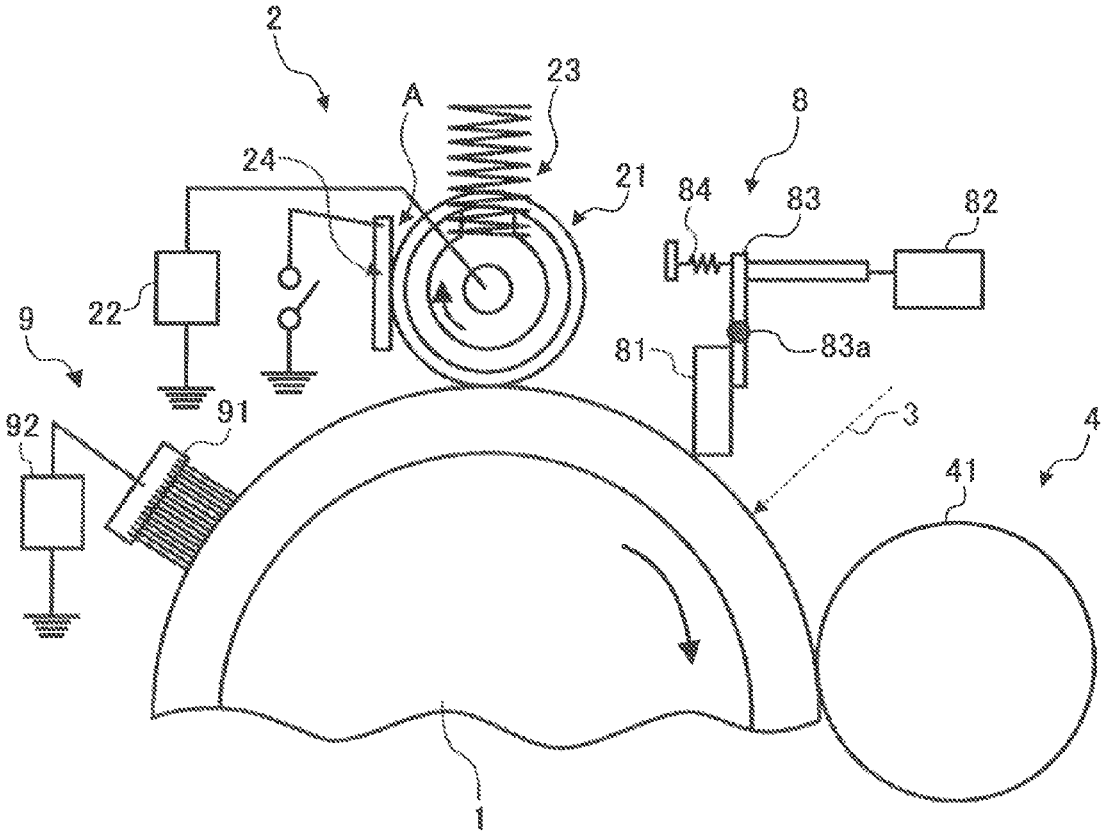
FIG. 5 is a schematic of a photosensitive member according to the modification.

The transfer residual toner having the negative polarity passing through the charging roller 21 is temporarily retained, as shown in FIG. 3, by the toner retaining unit 8 provided on an upstream side before an exposing unit 3. This toner retaining unit 8 includes an elastic blade 81 in contact with the photosensitive member. The elastic blade 81 is mounted on one end of a supporting plate 83. The other end of the supporting plate 83 has a spring 84 and a solenoid 82 mounted thereon. The spring 84 presses the supporting plate 83 in the left direction of the drawing. Also, a supporting portion 83*a* is provided approximately at the center of the supporting plate 83 to be slidably mounted on the process cartridge. When the solenoid 82 is in operation, the supporting plate 83 is pressed in the right direction in the drawing to be against the tension of the spring 84. Then, the supporting plate 83 rotates clockwise in the drawing centering on the supporting portion 83*a*, thereby making the elastic blade 81 to abut on the photosensitive member 1 with a pressure to some extent. When a latent image is formed by the exposing unit 3 on the surface of the photosensitive member, the solenoid 82 is in operation and the elastic blade 81 abuts on the photosensitive member 1. With this, the transfer residual toner is completely dammed up by the elastic blade 81. When a latent image is not formed, the solenoid 82 stops its operation. Then, the pressing force in the right direction in the drawing is lost, and the supporting plate 83 is pressed by the spring 84 instead in the left direction in the drawing. With this, the supporting plate 83 rotates counterclockwise in the drawing centering on the supporting portion 83*a*. As a result, the elastic blade 81 goes away from the photosensitive member 1 to cause the transfer residual toner retained by the elastic blade 81 to be returned to the surface of the photosensitive member and then be conveyed to a developing area via a latent image forming area. Then, the transfer residual toner is electrostatically absorbed on the carrier adhering to the developing roller to be collected by the developing device 4. As such, when a latent image is formed by the exposing unit 3 on the surface of the photosensitive member, the elastic blade 81 is made to abut on the photosensitive member 1 and, when a latent image is not formed, the elastic blade 81 is caused to be away from the surface of the photosensitive member. This prevents the transfer residual toner from adhering to the surface of the photosensitive member having a latent image being formed thereon and passing through the image forming area. As a result, it is prevented that the transfer residual toner serves as a shade to form an unexposed portion or that an abnormal image, such as white dots on a solid image portion, is formed.

Also, since the photosensitive member is negatively charged, the reversely-charged toner has a stronger adherence compared with the normally-charged toner. Therefore, the reversely-charged toner is prone to pass through between the elastic blade 81 and the photosensitive member. To retain the reversely-charged toner, it is required to press the elastic blade 81 strongly onto the photosensitive member. In the present embodiment, however, the reversely-charged toner is temporarily retained by the charging roller 21 on an upstream side of the elastic blade 81. Therefore, the entire transfer residual toner retained by the elastic blade 81 becomes a normally-charged toner. Since the normally-charged toner has a weak adherence to the photosensitive member, the transfer residual toner can be reliably retained even if the elastic blade 81 is not strongly pressed on the photosensitive member. As a result, such less stress on the elastic blade and photosensitive member can improve durability of the photosensitive member and the elastic blade. Also, the transfer residual toner can be reliably prevented from passing through the latent image area while the exposing unit is in operation. Also, setting conditions of the elastic blade 81 can be easily set.

On the other hand, the reversely-charged toner having a positive polarity and adhering to the charging roller 21 is temporarily retained, as shown in FIG. 3, by a charge injection plate 24 provided on the charging roller. The charge injection plate 24 abuts on the charging roller 21 with a predetermined pressure to control the amount of toner passing through between the charging roller 21 and the charge injection plate 24 such that the amount is equal to or smaller than 0.1 mg/cm$^2$ and, preferably, 0.05 mg/cm$^2$. This can prevent non-uniformity of charge. Also, the charge injection plate 24 is a metal plate made of stainless or the like, with one end being connected to a switch 25. When a latent image is formed by the exposing unit 3 on the surface of the photosensitive member, the switch 25 is in an OFF state and the charge injection plate 24 is in a float state. When a latent image is not formed, the switch 25 is set ON and the charge injection plate 24 is connected to the ground. With this, the potential of the charge injection plate 24 becomes 0 volt, thereby causing a potential difference between the charge injection plate 24 and the charging roller. As a result, a negative bias is applied from the charging roller 21 to the charge injection plate 24, thereby causing the reversely-charged toner retained in an area A between the charging roller 21 and the charge injection plate 24 to become a negatively-charged toner again. This negatively-charged toner again adheres to the surface of the photosensitive member to go through between the photosensitive member and the charging roller 21 for conveyance to the developing area.

In the present embodiment, the reversely-charged toner is temporarily retained by the charging roller 21, and is then injected by the charge injection plate 24 with a charge to become a normally-charged toner. As such, since a charge is injected to the temporarily-retained, reversely-charged toner, the reversely-charged toner can reliably become a normally-charged toner.

As such, the entire transfer residual toner conveyed to the developing area has been charged negatively. The developing roller 41 is applied with a bias reverse to a developing bias required for forming an image, that is, with a bias of +200 volts. With this, in the negatively-charged transfer residual toner, an electrostatic force to the developing roller occurs in the developing area. As a result, the transfer residual toner is electrostatically absorbed on the carrier on the developing roller to be collected by the developing device 4. The transfer residual toner collected by the developing roller in the developing device 4 is agitated and conveyed therein, and then again contributes to development.

In an exemplary modification, a charge injection assisting unit 9 is provided between the transfer device 5 and the charging device 2. This charge injection assisting unit 9 is provided to reverse the positive polarity of the toner reversely charged after transfer so that the toner becomes a normal negatively-charged toner. The charge injection assisting unit 9 includes a comb-tooth brush 91 made of a metal plate with a plurality of slits and a bias power supply 92 that applies a voltage to the comb-tooth brush 91. As being in contact with the photosensitive member, the comb-tooth brush 91 is applied with a negative bias from the bias power supply 92. With this, the reversely-charged positive toner adhering to the surface of the photosensitive member is reversed to a negatively-charged toner. Here, the bias to be applied to the comb-tooth brush 91 is required to be able to reverse the polarity of the toner to the polarity of the bias to be applied to the comb-tooth brush 91 with a potential difference from a potential on the surface of the photosensitive member. Specifically, the voltage to be applied to the comb-tooth brush 91 is −700 volts in consideration of the fact that the potential of photosensitive member is approximately −50 volts.

The transfer residual toner adhering to the photosensitive member 1 passes through the slits of the comb-tooth brush 91. At this time, the transfer residual toner comes in contact with the comb-tooth brush 91, thereby causing charge injection to the transfer residual toner and reversing the positively-charged toner to negative. With this, the reversely-charged positive toner can become a normal negatively-charged toner. Also, unlike a scheme of reversing the polarity of the reversely-charged toner by the charging roller, there is no need to consider a timing of applying a voltage to the comb-tooth brush 91, for example. Therefore, it is possible to keep the voltage applied to the comb-tooth brush 91 even during the image forming operation. Furthermore, part of the reversely-charged toner is reversed to negative before the toner passes through the charging device. Therefore, the amount of toner adhering to the charging roller can be reduced, thereby reducing load on the charging device.

Of the transfer residual toner that has passed through the comb-tooth brush 91, the negative toner passes through the charging device 2 to be temporarily retained by the elastic blade 81. The reversely-charged transfer residual toner with its polarity not being reversed by the comb-tooth brush adheres to the charging roller 21 to be temporarily retained by the charge injection plate 24. Then, the toner retained by the charge injection plate 24 when the exposing unit 3 does not form a latent image is reversed to negative. On the other hand, the toner temporarily retained by the elastic blade 81 is moved as the elastic blade 81 separated away, and is then collected by the developing roller in the developing device.

Also, the bias to be applied to the comb-tooth brush 91 may be a bias formed by superposing a direct-current bias with an alternate-current bias. With this, the amount of charge of the toner after transfer can be made uniform. Therefore, the toner can be prevented from adhering to the charging roller, thereby making it possible to keep the charging device always stable. Furthermore, the charge injection plate 24 as a charge injecting unit can be omitted and the comb-tooth brush 91 can be taken as the charge injecting unit.

In the present embodiment, separation of the elastic blade 81 and application of the bias to the charge injection plate 24 are performed in synchronization with the operation of the exposing unit 3. However, this is not meant to be restrictive. For example, if the image forming operation is completed or the image forming operation has been performed a predetermined number of times, the procedure may enter a cleaning mode, in which the elastic blade 81 is released and the bias is applied to the charge injection plate 24. Also, in the present embodiment, the photosensitive member 1, and the developing device 4, the charging device 2, the toner retaining unit 8, and others that surround the photosensitive member 1 are formed in the process cartridge 100. However, this is not meant to be restrictive. For example, other than the image forming processing devices described above, the transfer device 5, the paper conveyor belt 53, a paper conveyor cleaning device 56, and other components may be integrally formed in a process cartridge.

Figure 6:
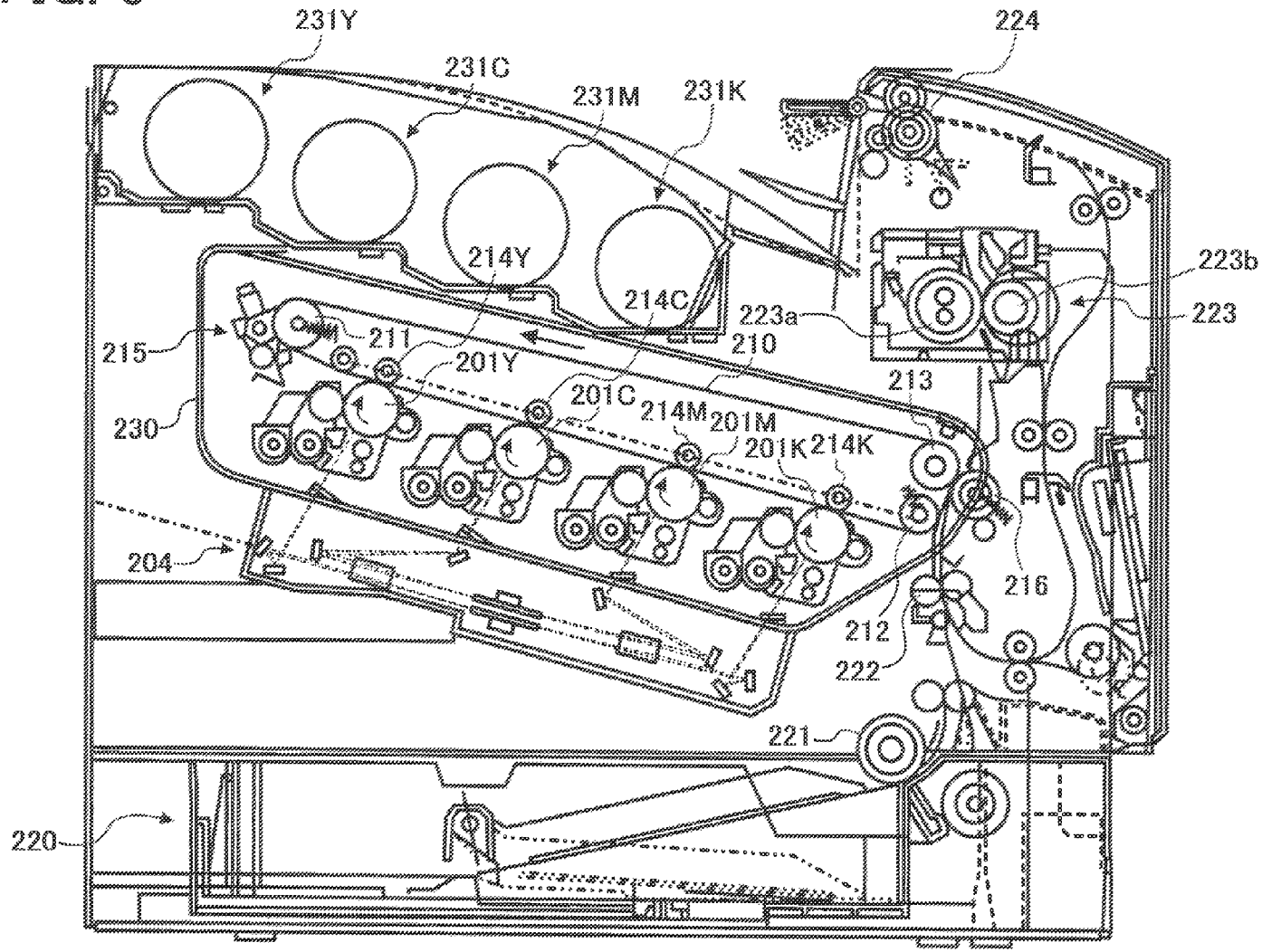
FIG. 6 is a schematic of a color image forming apparatus according to a third embodiment of the present invention.

In the present embodiment, description has been made to an exemplary case of a monochrome image forming apparatus having one photosensitive member and one developing device. However, the present invention is not limited to the case. For example, as shown in FIG. 6, the present embodiment can be applied to a color image forming apparatus including a plurality of photosensitive members and developing devices. In this case, the present embodiment can be used for an image forming processing unit for each of Y, M, C, and K colors. As a result, a waste tank or a cleaning device is not required to be provided for each color, thereby significantly reducing the size of the image forming apparatus. Furthermore, in the color image forming apparatus, the image forming processing unit for each of Y, M, C, K colors can be made as a process cartridge removable from the image forming apparatus body. Still further, it is also possible to form, in addition to the components described above, an intermediate transfer belt, intermediate transfer belt cleaning, and others, in a process cartridge.

For the toner for use in the printer described above, what is required is easy charge injection by the charge injecting unit, such as the comb-tooth brush 91 or the charge injection plate 24 of the charging device 2. If the toner is less prone to receive charge injection, the reversely-charged toner is less prone to be reversed to a normally-charged toner, which has the same polarity as that of the bias even if applied by the comb-tooth brush 91 or the charge injection plate 24. Therefore, the amount of toner electrostatically adhering to the charging roller 21, is increased, thereby increasing the load on the charging device. Moreover, if the toner is less prone to receive charge injection, the charge potential distribution of the normally-charged toner retained by the elastic blade 81 is wide, thereby causing a toner with a high charge potential and a toner with a low charge potential to be bound together. Such a bound toner presses at a single point on the elastic blade, thereby causing the elastic blade to be curled up at that point and to form a space between the photosensitive member and the elastic blade. Then, the toner passes through the space. Furthermore, although a smaller toner particle diameter more improves image quality, a toner having a too small particle diameter may pass through the elastic blade 81 more. This causes a latent image to be formed on the surface of the photosensitive member with the toner adhering thereto. As a result, an unexposed portion is formed, thereby causing white dots on a solid image portion. Therefore, the toner according to the first embodiment preferably has a resistance equal to or smaller than $1\times10^9$ ohm centimeters, an average-weight particle diameter of 5.0 to 10.0 micrometers, and an average peround equal to or larger than 0.85.

Any conventionally known method can be used as the toner manufacturing method according to the first embodiment. Binding resin, release agent, colorant, magnetic substance and others, as well as charge control agent in some cases, are mixed. Then, a kneader, such as a hot mill or extruder, is used for mixing, and then the resultant substance is cooled for solidification. Next, the resultant substance is crushed through crushing by a jet mill, turbo jet, Kryptron, or the like, and is then classified for obtaining a toner. To the toner, an external additive is added by using a super mixer, Henschel mixer, or the like.

For binding resin, any conventionally known resins can be used. Examples include styrene resin (monopolymer or copolymer including styrene or styrene substitution produce), such as styrene, poly-α-stilstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic ester copolymer, styrene-methacrylic acid ester copolymer, styrene-α-chloracrylate methyl copolymer, and styrene-acrylonitrile-acrylic ester copolymer, polyester resin, epoxy resin, vinyl chloride resin, rosin denatured maleic resin, phenol resin, polyethylene resin, polypropylene resin, petroleum resin, polyurethane resin, ketone resin, ethylene-ethyl acrylate copolymer, xylen resin, and polyvinyl butyrate resin.

In the first embodiment, polyester resin is particularly preferable. Polyester resin is obtained by polycondensation of alcohol and carboxylic acid. Examples of alcohol for use include glycols, such as ethylene glycol, diene glycol, triethylene glycol, and propylene glycol; etherified bisphenols, such as 1,4-bis(hydroxymeta) cyclohexane and bisphenol A, other bivalent alcohol monomer, and trivalent and larger polyalcohol monomer. Also, examples of carboxylic acid include bivalent organic acid monomers, such as maleic acid, fumaric acid, phthalic acid, isophthalic acid, terephthalic acid, succinic acid, and malonic acid; and trivalent and larger carboxylic acid monomers, such as 1,2,4-benzenetricarboxylic acid, 1,2, 5-benzenetricarboxylic acid, 1,2,4-cyclohexanetricarboxylic acid, 1,2, 4-naphthalenetricarboxylic acid, 1,2, 5-hexanetricarboxylic acid, 1, 3-dicarboxyl-2-methylenecarboxylicpropane, and 1,2,7, 8-octanetetracarboxylic acid.

Also, although one type of the resins described above can be used solely, two or more types of resin may be concurrently used. The scheme of manufacturing such resins is not particularly restricted, and any of massive polymerization, solution polymerization, emulsion polymerization, or suspension polymerization may be used.

As a release agent in the first embodiment may be any known release agent can be used. Particularly, it is preferable that carnauba wax, montan wax, and oxidized rice wax, which are of an esterified fatty acid type, be used singly or in combination. Preferably, carnauba wax is in form of microcrystal, and also preferably has an acid value equal to or smaller than 5 and a particle diameter equal to or smaller than 1 micrometer at the time of dispersion in toner binder. Montan wax is generally a montan-type wax refined from mineral and, as with carnauba wax, is preferably in form of microcrystal, with an acid value of 5 to 14. Oxidized rice wax is obtained from rice bran wax through air oxidation, and preferably has an acid value of 10 to 30. Other than those described above, any conventionally known release agents can be used by mixing, such as solid silicone varnish, higher fatty acid higher alcohol, montan-type ester wax, and low-molecular-weight polypropylene wax. The amount of these release agents with respect to the toner resin component is 1 to 20 weight percent and, preferable, 3 to 10 weight percent.

As a magnetic material in the first embodiment may be any known, conventionally-used magnetic fine powder, such as iron oxide, magnetite, and ferrite. The amount of addition of the magnetic material is 5 to 60 weight percent and, preferably, 15 to 45 weight percent.

Also, as an external additive, inorganic fine particles can be preferably used. A primary particle diameter of the inorganic fine particles is preferably 5 millimicrons to 2 microns and, particularly, 5 millimicrons to 500 millimicrons. Also, the specific surface according to the BET scheme is preferably 20 $m^2/g$ to 500 $m^2/g$. A use ratio of the inorganic fine particles to the resin component of the toner is preferably 0.01 to 5 weight percent and, particularly, 0.01 to 2.0 weight percent. Specific examples of inorganic fine particles include silica, alumina, titanium oxide, barium titanate, magnesium titanate, calcium titanate, strontium titanate, zinc oxide, tin oxide, silica sand, clay, mica, wollastonite, diatomaceous earth, chromic oxide, ceric oxide, colcothar, antimonic troxide, magnesium oxide, zirconium oxide, barium sulfate, barium carbonate, calcium carbonate, silicon carbide, and silicon nitride. Other than those described above, examples also include fine particles of a high-polymer type, such as polystyrene obtained through soap-free emulsion polymerization, suspension polymerization, or dispersion polymerization, methacrylic acid ester, acrylic ester copolymer, polycondensates, such as silicone, benzoguanamine, and nylon, and polymer particles of thermosetting resin. The external additive described above is used for coupling to increase hydrophobicity, and also can prevent deterioration in fluid characteristic and electric charge characteristic even under high humidity. Preferable examples of a coupling agent include a silane coupling agent, a sililation reagent, a silane coupling agent having an alkyl fluoride group, a coupling agent of a organic titanate type, and a coupling agent of an aluminum type.

As a colorant for use in the toner according to the first embodiment, any pigments and dyes conventionally used for toner can be used. Specifically, examples of the colorant include carbon black, lampblack, iron black, ultramarine, nigrosine dye, aniline blue, calco oil blue, oil black, and azo oil black, and are not particularly restrictive. The amount of use of the colorant is 1 to 10 weight percent and, preferably, 3 to 7 weight percent.

The toner according to the first embodiment may contain an electric charge control agent as required. Examples of the electric charge control agent include nigrosine dye, triphenylmethane dye, chrome-containing metal complex dye, chelate molybdate pigment, rhodamine dye, alkoxy amine, quaternary ammonium salt (including fluorine-modified quaternary ammonium salt), alkylamide, phosphorus simple substance or its compound, tungsten simple substance or its compound, fluorine activator, salicylate metal salt, and salicylate derivative metal salt. Specifically, examples include Bontron 03 of nigrosine dye, Bontron P-51 of quaternary ammonium salt, Bontron S-34 of metal-containing azo dye, E-82 of oxynaphthoic acid metal complex, E-84 of salicylate metal complex, and E-89 of phenol condensate (which are manufactured by Orient Chemical Industries, Ltd.); TP-302 and TP-415 of quaternary ammonium salt molybdenum complex (which are manufactured by Hodogaya Chemical Co., Ltd.); copy charge PSY VP2038 of quaternary ammonium salt, copy blue PR of a triphenylmethan derivative, and copy charge NEG VP2036 and copy charge NX VP434 of quaternary ammonium salt (which are manufactured by Hoechst AG); LRA-901, LR-147 of boron complex (which is manufactured by Japan Carlit Co., Ltd.); copper phthalocyanine, perylene, quinacridon, azo pigment, and high polymer compounds having a functional group, such as a sulfonic acid group, a carboxyl group, and a quaternary ammonium salt group.

FIRST EXAMPLE

| | |
|---|---|
| Polyester resin (weight average molecular weight: 325000, Tg: 67.5 degrees Celsius) | 89 weight percent |
| Polyethylene wax (molecular weight: 900) | 5 weight percent |
| Magnetite fine particles | 50 weight percent |
| Carbon black | 5 weight percent |

-continued

| | |
|---|---|
| (Ketjen Black EC, Ketjenblack International Corporation) | |
| Electric charge control agent (Spiron Black TR-H, Hodogaya Chemical Co., Ltd) | 1 weight percent |

With the formula above, a biaxial extruder is used to knead the components at 70 degrees Celsius. Then, an air crusher is used to crush and classify the components to obtain an weight-average particle diameter of 7.0 micrometers. Then, a Henschel mixer is used to mix 0.5 weight percent of silica (R-972, Nippon Aerosil Co., Ltd.) to obtain a toner A having physical properties shown in Table 2.

Next, toners according to first to ninth comparison examples are described.

FIRST COMPARISON EXAMPLE

| | |
|---|---|
| Polyester resin (weight-average molecular weight: 382000, Tg: 68.0 degrees Celsius) | 84 weight percent |
| Polyethylene wax | 5 weight percent |
| Magnetite fine particles | 45 weight percent |
| Carbon black (#44 manufactured by Mitsubishi Chemical Industrial Company) | 5 weight percent |
| Electric charge control agent (Spiron Black TR-H, Hodogaya Chemical Co., Ltd) | 1 weight percent |

With the formula above, a biaxial extruder is used to knead the components at 120 degrees Celsius. Then, an air crusher is used to crush and classify the components to obtain an weight-average particle diameter of 7.0 micrometers. Then, a Henschel mixer is used to mix 0.3 weight percent of silica (R-972, Nippon Aerosil Co., Ltd.) to obtain a toner B having physical properties shown in Table 2.

SECOND COMPARISON EXAMPLE

| | |
|---|---|
| Polyester resin (weight-average molecular weight: 382000, Tg: 68.0 degrees Celsius) | 84 weight percent |
| Polyethylene wax | 5 weight percent |
| Magnetite fine particles | 45 weight percent |
| Carbon black (#44 manufactured by Mitsubishi Chemical Industrial Company) | 20 weight percent |
| Electric charge control agent (Spiron Black TR-H, Hodogaya Chemical Co., Ltd) | 1 weight percent |

With the formula above, a biaxial extruder is used to knead the components at 120 degrees Celsius. Then, an air crusher is used to crush and classify the components to obtain an weight-average particle diameter of 8.0 micrometers. Then, a Henschel mixer is used to mix 0.3 weight percent of silica (R-972, Nippon Aerosil Co., Ltd.) to obtain a toner C having physical properties shown in Table 2.

THIRD COMPARISON EXAMPLE with the formula of the second comparison example, a biaxial extruder is used to knead the components at 120 degrees Celsius. Then, an air crusher is used to crush and classify the components to obtain an weight-average particle diameter of 4.0 micrometers. Then, a Henschel mixer is used to mix 0.3 weight percent of silica (R-972, Nippon Aerosil Co., Ltd.) to obtain a toner D having physical properties shown in Table 2.

FOURTH COMPARISON EXAMPLE

| | |
|---|---|
| Polyester resin (weight-average molecular weight: 280000, Tg: 61 degrees Celsius) | 89 weight percent |
| Carnauba wax | 5 weight percent |
| Magnetite fine particles | 50 weight percent |
| Carbon black (Ketjen Black EC, Ketjenblack International Corporation) | 3 weight percent |
| Electric charge control agent (Spiron Black TR-H, Hodogaya Chemical Co., Ltd) | 1 weight percent |

With the formula above, a biaxial extruder is used to knead the components at 140 degrees Celsius. Then, an air crusher is used to crush and classify the components to obtain an weight-average particle diameter of 4.0 micrometers. Then, a Henschel mixer is used to mix 0.5 weight percent of silica (R-972, Nippon Aerosil Co., Ltd.) to obtain a toner E having physical properties shown in Table 2.

FIFTH COMPARISON EXAMPLE

| | |
|---|---|
| Polyester resin (weight-average molecular weight: 325000, Tg: 67.5 degrees Celsius) | 89 weight percent |
| Polyethylene wax (molecular weight: 900) | 5 weight percent |
| Magnetite fine particles | 35 weight percent |
| Carbon black (Ketjen Black EC, Ketjenblack International Corporation) | 3 weight percent |
| Electric charge control agent (Spiron Black TR-H, Hodogaya Chemical Co., Ltd) | 1 weight percent |

With the formula above, a biaxial extruder is used to knead the components at 120 degrees Celsius. Then, an air crusher is used to crush and classify the components to obtain an weight-average particle diameter of 3.0 micrometers. Then, a Henschel mixer is used to mix 0.3 weight percent of silica (R-972, Nippon Aerosil Co., Ltd.) to obtain a toner C having physical properties shown in Table 2.

SIXTH COMPARISON EXAMPLE

| | |
|---|---|
| Polyester resin (weight-average molecular weight: 325000, Tg: 67.5 degrees Celsius) | 78 weight percent |
| Polyethylene wax (molecular weight: 900) | 5 weight percent |
| Magnetite fine particles | 45 weight percent |
| Carbon black (Ketjen Black EC, Ketjenblack International Corporation) | 7 weight percent |
| Electric charge control agent (Spiron Black TR-H, Hodogaya Chemical Co., Ltd) | 1 weight percent |

With the formula above, a biaxial extruder is used to knead the components at 70 degrees Celsius. Then, an air crusher is used to crush and classify the components to obtain an weight-average particle diameter of 5.0 micrometers. Then, a Henschel mixer is used to mix 0.5 weight percent of silica (R-972, Nippon Aerosil Co., Ltd.) to obtain a toner G having physical properties shown in Table 2.

SEVENTH COMPARISON EXAMPLE

| | |
|---|---|
| Polyester resin (weight-average molecular weight: 280000, Tg: 61 degrees Celsius) | 89 weight percent |
| Carnauba wax | 5 weight percent |
| Magnetite fine particles | 50 weight percent |
| Carbon black (Ketjen Black EC, Ketjenblack International Corporation) | 3 weight percent |
| Electric charge control agent (Spiron Black TR-H, Hodogaya Chemical Co., Ltd) | 1 weight percent |

With the formula above, a biaxial extruder is used to knead the components at 140 degrees Celsius. Then, an air crusher is used to crush and classify the components to obtain an weight-average particle diameter of 8.0 micrometers. Then, a Henschel mixer is used to mix 0.5 weight percent of silica (R-972, Nippon Aerosil Co., Ltd.) to obtain a toner H having physical properties shown in Table 2.

EIGHTH COMPARISON EXAMPLE

| | |
|---|---|
| Styrene-n-butylacrylate copolymer (weight-average molecular weight: 55000, Tg: 52 degrees Celsius) | 88 weight percent |
| Rice wax | 5 weight percent |
| Magnetite fine particles | 50 weight percent |
| Carbon black (Ketjen Black EC, Ketjenblack International Corporation) | 3 weight percent |
| Electric charge control agent (Spiron Black TR-H, Hodogaya Chemical Co., Ltd) | 1 weight percent |

With the formula above, a biaxial extruder is used to knead the components at 90 degrees Celsius. Then, an air crusher is used to crush and classify the components to obtain an weight-average particle diameter of 6.0 micrometers (weight average particle diameter/number average particle diameter=1.29). Then, a Henschel mixer is used to mix 0.5 weight percent of silica (R-972, Nippon Aerosil Co., Ltd.) to obtain a toner I having physical properties shown in Table 2.

NINTH COMPARISON EXAMPLE

| | |
|---|---|
| Polyester resin (weight-average molecular weight: 325000, Tg: 67.5 degrees Celsius) | 89 weight percent |
| Polyethylene wax | 5 weight percent |
| Magnetite fine particles | 50 weight percent |
| Carbon black (Ketjen Black EC, Ketjenblack International Corporation) | 3 weight percent |
| Electric charge control agent (Spiron Black TR-H, Hodogaya Chemical Co., Ltd) | 1 weight percent |

With the formula above, a biaxial extruder is used to knead the components at 120 degrees Celsius. Then, an air crusher is used to crush and classify the components to obtain an weight-average particle diameter of 11.0 micrometers. Then, a Henschel mixer is used to mix 0.3 weight percent of silica (R-972, Nippon Aerosil Co., Ltd.) to obtain a toner J having physical properties shown in Table 2.

Next, the resistance, weight-average particle diameter, and average peround of the toner of each of the first example and the first to ninth comparison examples were measured.

The resistance of each toner was measured as follows. A load of 6 t/cm$^3$ was imposed on 3.0 grams of the toner to form a disk-like pellet having a diameter of 40 millimeters, and then the pellet was measured by TR-10C dielectric loss measuring instrument (Ando Electric Co., Ltd.). Here, a frequency was 1 kilohertz, and RATIO is $11\times10^{-9}$. The measurement results area shown in Table 2.

The weight-average particle diameter of each toner was measured by using Coulter MULTISIZER 2e. An aperture diameter was 100 micrometers. An example of particle diameter distribution of a toner measured by such the measuring instrument described above is shown in Table 1. The weight-average particle diameters of the respective toners measured in the manner described above are shown in Table 2.

TABLE 1

COULTER MULTISIZER IIe PARTICLE DIAMETER DISTRIBUTION

| CH | RANGE OF PARTICLE DIAMETER | WEIGHT PERCENT | NUMBER PERCENT |
|---|---|---|---|
| 1 | 1.26-1.59 | 0.00 | 0.00 |
| 2 | 1.59-2.00 | 0.00 | 0.00 |
| 3 | 2.00-2.52 | 0.51 | 6.29 |
| 4 | 2.52-3.17 | 2.03 | 12.63 |
| 5 | 3.17-4.00 | 6.02 | 19.26 |
| 6 | 4.00-5.04 | 14.84 | 24.04 |
| 7 | 5.04-6.35 | 26.47 | 21.62 |
| 8 | 6.35-8.00 | 28.37 | 12.10 |
| 9 | 8.00-10.1 | 15.52 | 3.48 |
| 10 | 10.1-12.7 | 4.64 | 0.53 |
| 11 | 12.7-16.0 | 0.86 | 0.05 |
| 12 | 16.0-20.2 | 0.27 | 0.01 |
| 13 | 20.2-25.4 | 0.00 | 0.00 |
| 14 | 25.4-32.0 | 0.00 | 0.00 |
| 15 | 32.0-40.3 | 0.00 | 0.00 |
| 16 | 40.3-50.8 | 0.00 | 0.00 |

The average peround of each toner was measured by using FPIA-2100, which is a flow-type particle image analyzer manufactured by SYSMEX Corporation. For measurement, primary sodium chloride was used to prepare 1-percent NaCl solution. Then, 0.1 to 5 milliliters of a surface-active agent, preferably, alkylbenzene sulfonate, was added to a fluid 50 to 100 milliliters passing through a filter of 0.45 micrometers, and also 1 to 10 milligrams of a reagent was added. The result was then subjected to a dispersing process in an ultrasonic dispersing unit for one minute, thereby preparing a dispersion fluid having a particle density of 5000 to 15000/microliter for measurement. With a diameter of a circle having the same area as an image area of a two-dimensional image shot by a charge-coupled device (CCD) camera being taken as a circle-equivalent diameter, the circle-equivalent diameter equal to or more than 0.6 micrometers was considered effective in view of the accuracy of the pixels of the CCD and was used for calculation of the average peround. The average peround can be obtained by calculating a peround of each particle, adding the calculated perounds of the respective particles, and then dividing the addition result by the number of particles. The average peround of each particle is calculated by dividing a peripheral length of a circle having the same projection area as an particle image by a peripheral length of a particle projection image. The results are shown in Table 2.

A comparison experiment was performed by using a printer obtained by partially modifying RICOH Imagio MF7070. As a developing device of the printer, a developing device incorporated in RICOH Imagio MF150 was used. Developing devices each accommodating the toner of one of the first example and the first to ninth comparison examples were prepared, and these developing devices were exchangeably set in the printer for comparison experiment among these toners. A gap between the photosensitive member and the developing roller was set to be 0.3 millimeters. Also, it was set that a charging bias of −1000 volts was applied to uniformly charge the surface of the photosensitive member at −500 volts. Furthermore, the charge injection plate 24 was set to be grounded at 0 volt when the switch is in an ON state, thereby causing the bias of −1000 volts to be applied to the reversely-charged toner retained by the charge injection plate. Still further, the comb-tooth brush 91 was applied with a bias of −700 volts. Other conditions were set similarly to the embodiment described above. Then, a test image is printed on 1000 sheets by the printer. During printing, the elastic blade was never allowed to be away from the photosensitive member. Also, when the number of printed sheets reached a predetermined number, the switch of the charge injection plate 24 was set in an ON state to cause the charging bias to be applied to the reversely-charged toner retained by the charge injection plate 24 for a predetermined period. Under the conditions described above, after printing 1000 sheets, the amount of charge on the toner passing through the elastic blade abutting on the photosensitive member and the amount of such toner were measured. Also, an image printed on the 1000-th sheet was visually observed.

The amount of toner was calculated as follows. A nozzle was used with its tip being brought in contact with the surface of the photosensitive member positioned in the latent image forming area to suck the toner adhering to the photosensitive member by using a suction pump. The sucked toner was retained inside the nozzle with a filter. The nozzle is removable from the pump, and the weight of the nozzle was measured before and after toner suction to calculate the weight of the adhering toner. Then, by dividing the calculated toner weight by a cross-sectional area of the tip of the nozzle, the amount of toner (mg/cm$^2$) passing through the blade was calculated. Also, the amount of charge on the toner was calculated by measuring the amount of charge attached to the filter per unit area. The results were shown in Table 2. Here, in evaluation of the image state, a circle indicates that no white dots were observed in a black solid image, and a cross indicates that white dots were observed in a black solid image.

TABLE 2

| | | TONER RESISTANCE Ω-cm | WEIGHT-AVERAGE PARTICLE DIAMETER μm | AVERAGE PEROUND | AMOUNT OF CHARGE AFTER PASSING THROUGH BLADE μC/g | AMOUNT OF TONER AFTER PASSING THROUGH BLADE mg/cm$^2$ | STATE OF IMAGE |
|---|---|---|---|---|---|---|---|
| FIRST EMBODIMENT | TONER A | $2 \times 10^8$ | 7 | 0.85 | 30 | 0.02 | ○ |
| FIRST COMPARISON EXAMPLE | TONER B | $1 \times 10^{11}$ | 7 | 0.89 | 18 | 0.10 | X |
| SECOND COMPARISON EXAMPLE | TONER C | $1 \times 10^{10}$ | 8 | 0.82 | 15 | 0.10 | X |
| THIRD COMPARISON EXAMPLE | TONER D | $3 \times 10^{10}$ | 4 | 0.80 | 20 | 0.15 | X |
| FOURTH COMPARISON EXAMPLE | TONER E | $2 \times 10^9$ | 4 | 0.87 | 25 | 0.20 | X |
| FIFTH COMPARISON EXAMPLE | TONER F | $2 \times 10^8$ | 3 | 0.82 | 20 | 0.20 | X |
| SIXTH COMPARISON EXAMPLE | TONER G | $8 \times 10^9$ | 5 | 0.88 | 25 | 0.05 | X |
| SEVENTH COMPARISON EXAMPLE | TONER H | $5 \times 10^{10}$ | 8 | 0.85 | 20 | 0.10 | X |
| EIGHTH COMPARISON EXAMPLE | TONER I | $5 \times 10^{10}$ | 4 | 0.88 | 20 | 0.15 | X |
| NINTH COMPARISON EXAMPLE | TONER J | $1 \times 10^9$ | 11 | 0.80 | 25 | 0.10 | X |

As can be seen from Table 2, as for the toner A of the first example, the amount of toner passing through the blade was 0.02 mg/cm$^2$, and no white dots were observed in a black solid portion of the image and thus a satisfactory image was obtained. On the other hand, as for the toners B to J of the first to ninth comparison examples, the amount of toner passing through the blade is equal to or more than 0.05 mg/cm$^2$ and, upon observation of the image, white dots were observed in a black solid portion.

Also, the amount of charge on the toner A was −30 μC/g, which was down to the same level as that of the amount of the charge before transfer. Moreover, the charge distribution was a narrow normal distribution centering on −30 μC/g. On the other hand, while the toner B shows satisfactory values of a weight-average particle more than 5 micrometers and an average peround equal to or more than 0.85, the amount of charge on the toner B with a toner resistance more than $1\times10^9$ ohm centimeters was −18 μC/g, and the charge distribution was an unnormalized distribution. As a result, the amount of toner passing through between the elastic blade and the photosensitive member was 0.10 mg/cm$^2$. A possible reason for this is as follows. Since the toner B of the first comparison example has a high toner resistance, charge injection by the comb-tooth brush 91 or the charge injection plate 24 to the toner B is difficult. As a result, even if the reversely-charged toner becomes a negatively-charged normal toner, the amount of charge is not returned to but becomes higher than the amount of charge before transfer (−30 μC/g). Also as for a toner with its negative charge characteristic being decreased, charge injection by the comb-tooth brush 91, the charging bias, or the like is difficult. Therefore, such toner has an amount of charge higher than the amount of charge before transfer. As a result, the amount of charge is −18 μC/g, which is higher than the amount of charge before transfer. Furthermore, the charge distribution of the toner temporarily retained by the elastic blade 81 is not a normal distribution, but becomes such that a toner having a high charge potential and a toner having a low charge potential are mixedly present. This causes binding of the toner having a high charge potential and the toner having a low charge potential retained by the elastic blade, and the bound toners press a single point on the elastic blade. As a result, the pressure of the bound toners on the elastic blade is increased to allow the bound toners to pass through between the photosensitive member and the elastic blade. Consequently, with the amount of toners passing through between the elastic blade and the photosensitive member being 0.10 mg/cm$^2$, these toners serve as a shade at the time of forming a latent image to form white dots on a black solid portion. On the other hand, as for the toner A of the first example, since its toner resistance is smaller than $1\times10^9$ ohm centimeters, charge injection by the comb-tooth brush 91 or the charge injection plate 24 is easily performed. Therefore, a reversely-charged toner and a toner with its amount of negative charge being decreased are prone to be returned by such a charge injecting unit to the amount of charge before transfer (−30 μC/g). As a result, most of the toner temporarily retained by the elastic blade 81 has an amount of charge of approximately −30 μC/g. Therefore, toners do not repel each other or bind together. Thus, the toner presses the elastic blade 81 in a state where the toner is dispersed on the elastic blade 81. Since the toner uniformly presses the elastic blade, the pressure of the toner is increased, and the toner seldom passes through between the photosensitive member and the elastic blade.

As for the toner J of the ninth comparison example, its toner resistance and weight-average particle diameter have satisfactory values, but its average peround is 0.80, which is lower than 0.85. As a result, the amount of the toner passing through between the elastic blade and the photosensitive member is 0.10 mg/cm$^2$. A possible reason for this is as follows. In a toner having its average peround is smaller than 0.85, toner particles are indefinite in shape, and the state of collection of the toner image is nonuniform. Therefore, transfer efficiency is low such that not only the reversely-charged toner or the toner having a high charge potential but also a toner having a desired charge characteristic becomes a transfer residual toner. Also, since the toner particles are indefinite in shape, it is difficult to efficiently inject a charge into the toner. As a result, it is difficult for the comb-tooth brush 91 or the charge injection plate 24 to return the reversely-charged toner and the toner having a high potential to a desired charge characteristic. Therefore, although the charge amount of the toner retained by the elastic blade 81 shows a satisfactory charge characteristic of −25 μC/g, the charge distribution has two peaks, one centering on an amount of charge at a low potential and the other centering on an amount of charge at a high potential. Thus, also in the toner J, the toner having a low potential and the toner having a high potential are bound together to increase the pressure on the elastic blade 81, thereby passing through between the photosensitive member and the elastic blade. As a result, the amount of toner passing through between the photosensitive member and the elastic blade is 0.10 mg/cm$^2$, thereby causing white dots on a black solid portion of the image. Also, upon observation of the image of the toner J, the image was found to have roughness. A possible reason for this is that the weight-average particle diameter is equal to or more than 10 micrometers.

Also, as for the toner F, even though the toner F is lower in toner resistance compared with the toner C, the amount of the toner passing through between the elastic blade and the photosensitive member is 0.20 mg/cm$^2$, which is more than that of the toner C. A possible reason for this is that, since the weight-average particle diameter of the toner F is small, that is, smaller than 5 micrometers, the ratio of the toner passing through between the photosensitive member and the elastic blade is more than that of the toner C.

As clear from the observation described above, by using a toner having a toner resistance of $1\times10^9$ ohm centimeters, a weight-average particle diameter of 5 micrometers to 10 micrometers, and an average peround equal to or more than 0.85, a satisfactory image can be obtained.

As described above, according to the first embodiment, the transfer residual toner that has not been electrostatically transferred onto the transfer sheet P at the transfer nip and remains on the surface of the photosensitive member is temporarily retained by the toner retaining unit 8 before reaching the latent image forming area. Then, when passing through the latent image forming area, the transfer residual toner is returned onto the surface of the photosensitive member at a timing such as that when writing is not performed by the exposing unit 3 on the surface of the photosensitive member. With this, the transfer residual toner can be prevented from adhering to the surface of the photosensitive member passing through the latent image area while the exposing unit 3 is forming a latent image. Thus, an unexposed portion is prevented from being formed due to the transfer residual toner. As a result, white dots can be prevented from occurring on a solid image portion, thereby allowing a satisfactory image to be obtained. Also, by using a toner having a toner resistance of $1\times10^9$ ohm centimeters, a weight-average particle diameter of 5 micrometers to 10 micrometers, and an average peround equal to or more than 0.85, the toner can be reliably retained temporarily by the temporarily-retaining unit. Therefore, the transfer residual toner can be more prevented from not being retained by the temporarily-retaining unit and passing through the latent image forming area while a latent image is being formed. Thus, white dots can be more prevented from occurring on a solid image portion, thereby allowing a satisfactory image to be obtained.

Also, according to the first embodiment, before passing through the charging roller, the transfer residual toner is injected with a charge by the charge injecting unit to become a transfer residual toner having the same polarity as that of the charging bias. With this, the reversely-charged toner can be made as a normally-charged toner having the same polarity as that of the charging bias, thereby preventing the transfer residual toner from adhering to the charging roller. Thus, the surface potential of the photosensitive member can always be made as a desired potential, and an insufficient charge, such as a uneven charge, can always be prevented from occurring. As a result, a satisfactory image without degradation in image density or background stain can be obtained. Furthermore, the entire transfer residual toner can be made as a normal negatively-charged toner. Since the photosensitive member is negatively charged, with the transfer residual toner being negative, adhesion to the photosensitive member can be reduced. As a result, the transfer residual toner can be reliably collected by the developing device.

Furthermore, according to the first embodiment, the transfer device 5 and the charging device 2 have provided therebetween the charge injection assisting unit 9. With the comb-tooth brush 91 of the charge injection assisting unit 9, a charge having the same polarity as that of the charging bias is injected. With this, before passing through the charge injecting unit, part of the reversely-charged toner can be reversed in polarity to have the same polarity as that of the charging bias. Therefore, the reversely-charged toner can be reliably made by the charge injecting unit as a normally-charged toner. As a result, reduction in charging performance due to adherence of the reversely-charged toner to the charging roller 21 can be further prevented. Still further, the charge of the transfer residual toner can be reliably controlled, thereby reliably collecting the transfer residual toner in the developing device. Still further, according to the first embodiment, the elastic blade 81 abuts on the photosensitive member 1 while the exposing unit is in operation, that is, while a latent image is being formed, and is away from the photosensitive member while the exposing unit is not in operation, that is, while a latent image is not being formed. With this, the transfer residual toner is prevented from adhering to the surface of the photosensitive member passing through the latent image forming area while the exposing unit 3 is forming a latent image. Therefore, an unexposed portion is prevented from being formed due to the transfer residual toner. As a result, white dots can be prevented from occurring on a solid image portion, thereby allowing a satisfactory image to be obtained.

Still further, according to the first embodiment, the charging roller 21 with a reversely-charged toner adhering thereto serves as a unit of temporarily retaining the reversely-charged toner. Also, the charging roller 21 serving as the unit of temporarily retaining the reversely-charged toner is provided with the charge injection plate 24 serving as a charge injecting unit. The reversely-charged toner temporarily retained by the charging roller 21 is injected with a charge by the charge injection plate 24, to become a normally-charged toner. As such, with a charge being injected into the temporarily-retained, reversely-charged toner, a normally-charged toner can be reliably produced. Thus, the entire toner conveyed to the developing area can be made as a normally-charged toner, thereby reliably collecting the toner in the developing device.

Still further, the transfer residual toner adhering to the charging roller 21 can be reliably removed, thereby preventing reduction in charge performance due to adherence of the reversely-charged toner to the charging roller 21. Also, unlike the conventional technology, it is not required to provide a cleaning device for cleaning the toner adhering to the charging roller 21. Accordingly, it is not required to provide, for example, a waste toner tank for accommodating the transfer residual toner collected from the charging roller. This significantly contributes to downsizing of the device.

Still further, according to the first embodiment, the elastic blade 81 serving as a temporarily-retaining unit is provided on a downstream side in a moving direction of the photosensitive member after the charge injection plate 24 serving as a charge injecting unit. With this, the entire transfer residual toner retained by the elastic blade 81 becomes a normally-charged toner. Since the normally-charged toner has a weak adherence to the photosensitive member compared with the reversely-charged toner, the transfer residual toner can be reliably retained even if the elastic blade 81 is not strongly pressed on the photosensitive member. Thus, such less stress on the elastic blade 81 and photosensitive member can improve durability of the elastic blade 81 and the photosensitive member. Also, setting conditions of the elastic blade 81 can be easily set.

Still further, with the components being formed in a process cartridge, if any component incorporated in the process cartridge 100 reaches its end of life or requires maintenance, all what is required is to replace the process cartridge 100. This improves convenience.

Figure 7:
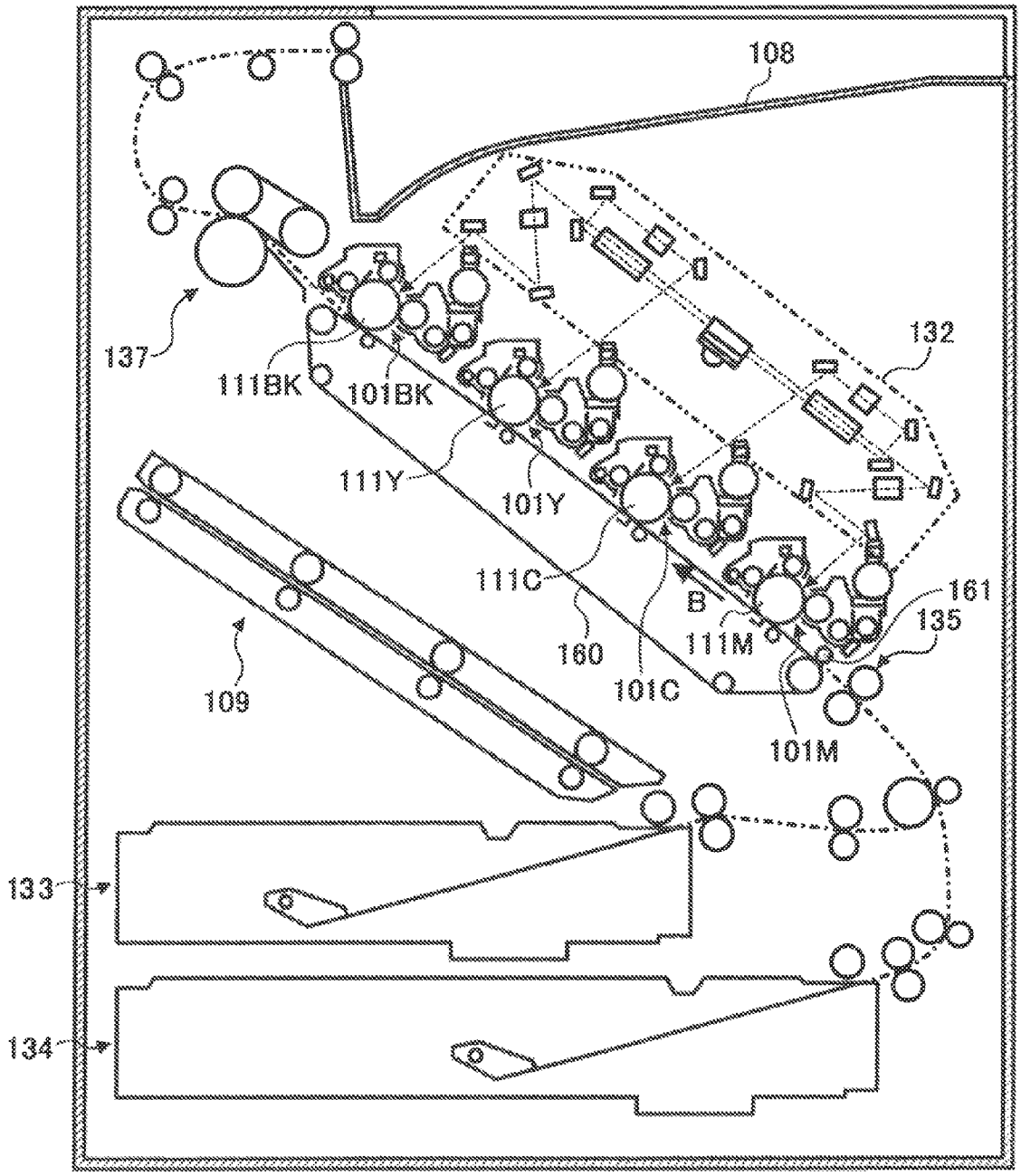
FIG. 7 is a schematic of a laser printer according to a second embodiment of the present invention.

FIG. 7 is a schematic structural diagram of a laser printer according to the second embodiment. In this laser printer, four image forming units 101M, 101C, 101Y, and 101BK for forming an image of magenta (M), cyan (C), yellow (Y), and black (BK), respectively, (hereinafter, suffixes M, C, Y, and BK attached to reference numerals represent members for magenta, cyan, yellow, and black, respectively) are disposed in this order from an upstream side in a moving direction (in a direction indicated by an arrow A in the drawing) of transfer paper 100 (refer to FIG. 8) serving as a transfer material. These image forming units 101M, 101C, 101Y, and 101BK each include a photosensitive unit having a corresponding one of photosensitive drums 111M, 111C, 111Y, and 111BK, and a developing unit. Also, the image forming units 101M, 101C, 101Y, and 101BK are disposed so that rotational axes of the photosensitive drums 111M, 111C, 111Y, and 111BK in the respective photosensitive units are parallel to each other and are disposed with predetermined pitches in the transfer-paper moving direction.

In addition to the image forming units 101M, 101C, 101Y, and 101BK described above, the laser printer also includes, for example, an optical writing unit 102, paper feeding cassettes 103 and 104, a transferring unit 6 having a transfer belt 160 serving as a belt for conveying a transfer member to the transferring unit opposed to the respective photosensitive drums 111, paired resist rollers 105 that supply the transfer paper 100 serving as a transfer member to the transfer belt 160, a fixing unit 107 of a belt fixing type, a paper delivery tray 108, and a reversing unit 109. The laser printer also includes, for example, a manual paper feeding tray, a toner refueling tank, a waste toner bottle, and a power supply unit, although not shown.

The optical writing unit 102 includes, for example, a light source, a polygon mirror, an f-θ lens, and a reflective mirror. Based on image data, the surface of each of the photosensitive drums 111M, 111C, 111Y, and 111BK is scanned with emitted laser light.

A one-dot-chain line in FIG. 7 indicates a path of conveying the transfer paper 100. The transfer paper 100 supplied from the paper feeding cassette 103 or 104 is conveyed by a conveyor roller as being guided by a conveyance guide not shown to be forwarded to a temporally-hold position at which the resist rollers 105 are provided. The transfer paper 100 is supplied and conveyed through the resist rollers 105 to the transfer belt 160 at a predetermined timing to pass through each of the transferring units opposed to the photosensitive drums 111M, 111C, 111Y, and 111BK. With this, toner images formed by the image forming units 101M, 101C, 101Y, and 101BK on the photosensitive drums 111M, 111C, 111Y, and 111BK are sequentially superposed on the transfer paper, thereby forming a color image on the transfer member. The transfer paper 100 with the color image being formed thereon is fixed with a toner image at the fixing unit 107, and is then delivered onto the paper delivery tray 108.

Figure 8:
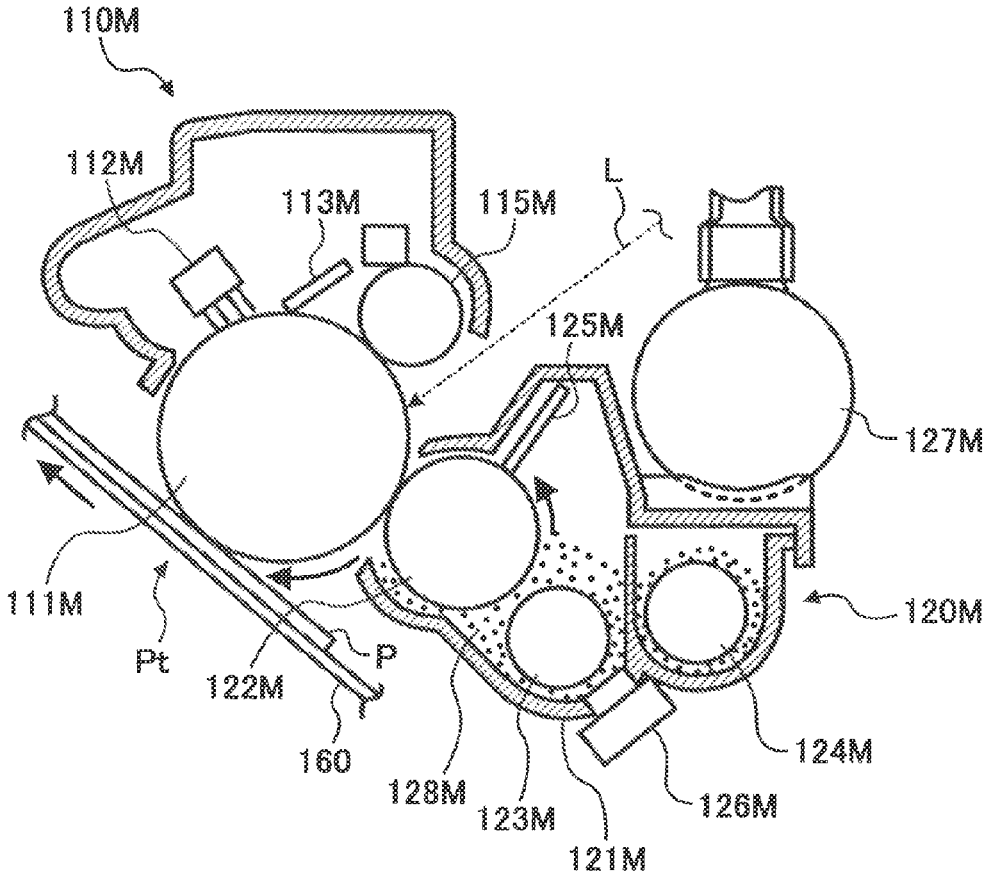
FIG. 8 is an enlarged schematic of a magenta image forming unit.

FIG. 8 is a schematic enlarged diagram of the structure of the magenta image forming unit 101M from out of the image forming units 101M, 101C, 101Y, and 101BK. Since the other image forming units 101C, 101Y, and 101BK have the same structure as that of the magenta image forming unit 101M, their structure is not described herein.

In FIG. 8, as described above, the image forming unit 101M includes a photosensitive unit 110M and a developing unit 102M. The photosensitive unit 110M includes the photosensitive drum 111M as well as a charging roller 115M of a non-contact type, that uniformly charges the surface of the photosensitive drum. The photosensitive unit 110M also includes a blade 113M serving as a retaining member that temporarily retains a transfer residual toner on the surface of the photosensitive member and a charging brush 112M that causes the transfer residual toner on the surface of the photosensitive drum to be normally charged. The charging brush 112M is connected to a power supply not shown for applying a bias.

In the photosensitive unit 110M, the surface of the photosensitive drum 111M is uniformly charged by the charging roller 115M applied with a voltage. The charging roller 115 is applied with a direct-current voltage of −130 volts to uniformly charge the surface of the photosensitive member at −700 volts. When the surface of the photosensitive drum 111M is scanned with emitted laser light modulated and deflected by the optical writing unit 102, an electrostatic latent image is formed on the surface of the photosensitive drum 111M. The electrostatic latent image on the photosensitive drum 111M is developed at the developing unit 102M, which will be described further below, to become a magenta toner image. At a transferring portion Pt through which the transfer paper 100 on the transfer belt 160 passes, the toner image on the photosensitive drum 111M is transferred on to the transfer paper 100.

The developing unit 102M uses, as a developer for developing the electrostatic latent image, a binary developer (hereinafter, "developer") 128M containing a magnetic carrier and a negatively-charged toner. Any known toner can be used, such as a grinded toner and polymerized toner. This developing unit 102M also includes, for example, a development sleeve 122M made of a non-magnetic material serving as a developer carrier disposed to be partially exposed from an opening on a development case 121M on a photosensitive-drum side; a magnet roller (not shown) serving as a magnetic field generating unit fixedly disposed inside the development sleeve 122; conveyor screws 123M and 124M; a development doctor 125M; a magnetic permeability sensor 126M serving as a toner density sensor (T sensor) that detects a magnetic permeability of the developer 128M; and a powder pump 127M. The development sleeve 122M is applied with a development bias voltage having an alternate-current voltage AC (alternate-current component) superposed by a development-bias power supply not shown, which serves as a development electric field forming unit, on a negative direct-current voltage (direct-current component). Thus, the development sleeve 122M is biased at a predetermined voltage with respect to a metal base layer of the photosensitive drum 111M.

In FIG. 8, the developer 128M accommodated in the development case 121M is agitatedly conveyed by the conveyor screws 123M and 124M to be charged by friction. Next, part of the developer 128M is carried on the surface of the development sleeve 122M, its layer thickness is regulated by the development doctor 125M, and the developer 128M is then conveyed to a developing position opposed to the photosensitive drum 111M. At the developing position, with the charged toner in the developer on the development sleeve 122M, the electrostatic latent image on the photosensitive drum 111M is developed.

The toner density of the developer 128M in the development case 121M is reduced with consumption of the developer associated with image formation. Therefore, according to an image area and a detection value (Vt) of the magnetic permeability sensor 126M, a toner is supplied as required from a toner cartridge (not shown) by the powder pump 127M, thereby making the toner density approximately constant. Toner supply is performed based on a difference ΔT (=Vref−Vt) between a toner-density target value (Vref) and Vt. When ΔT indicates a +(plus) value, it is determined that the toner density is sufficiently high and therefore no toner is additionally supplied. When ΔT indicates a −(minus) value, as |ΔT| is larger, the amount of toner supply is increased so that Vt is close to Vref. Also, by performing a process control (for example, a mode in which a plurality of half tones or solid patterns formed on the photosensitive drum 111M are detected by a reflection density sensor for conversion to an amount of adherence, and are set so that the amount of adherence is equal to a target amount of adherence) once for 10 sheets (depending on a copy speed, approximately 5 to 200 sheets), Vref, the charge potential, and the amount of light are set. To perform such toner density control, a controlling unit not shown is provided. The controlling unit includes, for example, a CPU, ROM, RAM serving as a storage unit, and an I/O interface.

Also, of the four photosensitive drums 111M, 111C, 111Y, and 111BK, only the BK photosensitive member 111BK located on the most downstream side always abuts on the transfer belt. Such a state is referred to as a transfer-nip continuous contact state. The remaining photosensitive drums 111M, 111C, and 111Y can abut on or be away from the transfer belt.

Furthermore, the image forming units 101M, 101C, 101Y, and 101BK are formed in a process cartridge, and the process cartridge is structured to be removed from the device body.

The four photosensitive drums 111M, 111C, 111Y, and 111BK abut on the transfer belt 160. The electrostatic absorption roller 161 provides the transfer paper 100 with a charge having the same polarity as the polarity of the toner, thereby causing the transfer belt 160 to absorb the transfer paper 100. With this, as described above, an insufficient transfer of the toner image due to charge-up of the transfer member can be solved.

The transfer paper 100 is conveyed as being absorbed by the transfer belt 160. Then, color toner images of magenta, cyan, and yellow formed on the color drums 111M, 111C, and 111Y on the upstream are sequentially superposed each other for transfer, and finally, a black toner image formed on the BK drum 111BK is superposed and transferred on the transfer paper 100. Then, the tone images superposed and transferred on the transfer paper 100 are fixed by the fixing unit 107 to produce a permanent full-color image.

In a monochrome image forming mode of forming, for example, a black monochrome image, in FIG. 7, the color drums 111Y, 111C, and 111M are separated away from the transfer belt 160, and only the BK drum 111BK where a toner image with a black toner is formed is made to abut on the transfer belt 160. Then, the transfer paper 100 is conveyed to a transfer nip of the BK drum 111BK, and a black toner image is transferred and then fixed by the fixing unit 107, thereby forming a black monochrome image.

Next, description is made to a feature of the present invention, that is, cleaning of the transfer residual toner remaining on the surface of the photosensitive drums 101. FIG. 2A is a graph of charge potential distribution immediately before transfer of the toner carried on the photosensitive drums 101. FIG. 2B is a graph of charge potential distribution of a transfer residual toner remaining on the photosensitive drums 101 after transfer. As shown in FIG. 2A, the amount of charge of the toner immediately before transfer is distributed centering on approximately −30 μC/g, and most of the toner has a normal negative charge. On the other hand, the amount of charge of the transfer is distributed centering on approximately −2 μC/g. In general, most of the toner does not have a desired charge because of, for example, receiving a charge injection of a positive bias applied to a primary transfer roller 114. As a result, the transfer residual toner includes a reversely-charged toner, as shown in a diagonally-shaded area in FIG. 2B, with its polarity being reversed to positive.

The transfer residual toner mixed with the reversely-charged toner with its polarity being reversed to positive as described above passes, as adhering to the surface of the photosensitive member, through the charging brush 112M. The charging brush 112M is applied with a negative bias from a power supply device not shown to reverse the positive polarity of the reversely-charged toner adhering to the surface of the photo sensitive member to produce a negatively-charged toner. With this, the polarity of the transfer residual toner on the photosensitive drum 111M passing through the charging brush 112M can be uniformly made negative. Here, the charging brush 112M is applied with a bias allowing the toner to be reversed in polarity to the polarity of the bias based on a potential difference from a potential of the surface of the photosensitive drum.

The transfer residual toner on the photosensitive drum 111M passing through the charging brush is temporarily retained by the blade 113M. The blade 113M is structured to be in contact with or away from the photosensitive drum, and is away from the surface of the photosensitive member at a predetermined timing. Also, as shown in FIG. 8, the blade 113M abuts on the photosensitive drum in a trading direction with respect to the moving direction of the photosensitive drum. The blade 113M that temporarily retains the transfer residual toner is disposed on an upstream side before the charging roller 115M with respect to the moving direction of the photosensitive drum 111M. To prevent the transfer residual toner from passing through the latent image forming area while a latent image is being formed, a blade that temporarily retains the transfer residual toner may be provided between the charging roller 115M and the latent image forming area. However, with a blade being provided between the charging roller 115M and the latent image forming area, a distance after charging on the surface of the photosensitive member until development is increased, thereby changing the potential on the surface of the photosensitive member and leading to possible image degradation. As described above, with the blade 113M being disposed on the upstream side before the charging roller 115M with respect to the moving direction of the photosensitive drum, the moving distance of the photosensitive drum after charging until development can be minimized, thereby reducing a change in potential on the surface of the photosensitive member.

Figure 9:
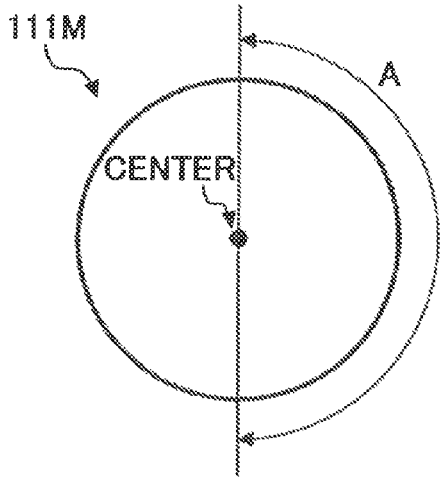
FIG. 9 is a schematic diagram for explaining a position of a blade.

Also, the blade 113M is provided so that the retained toner does not fall by self weight. Specifically, as shown in FIG. 9, the blade 113M is preferably provided in an area A where a position in a vertical direction on the surface of the photosensitive member goes down with movement.

If the transfer residual toner retained by the blade 113M is a mixture of a reversely-charged toner and a normally-charged toner, these reversely-charged toner and normally-charged toner may be electrostatically bound together while being retained by the blade. If the bound transfer residual toner is returned to the surface of the photosensitive member at a predetermined timing, the toner may inconveniently be unable to go through a space between the charging roller and the photosensitive drum to get caught. This causes an insufficient charge to invite image degradation. On the other hand, in the second embodiment, the polarity of the transfer residual toner is uniformly made negative by the charging brush 112M before the transfer residual toner is temporarily retained by the blade 113M. As a result, the transfer residual toner can be prevented from being bound together while being retained by the blade. Thus, the toner returned to the surface of the photosensitive member from the blade 113M does not get caught in the space between the photo sensitive drum and the charging roller 115M, thereby preventing an insufficient charge and other inconveniences.

Figure 10:
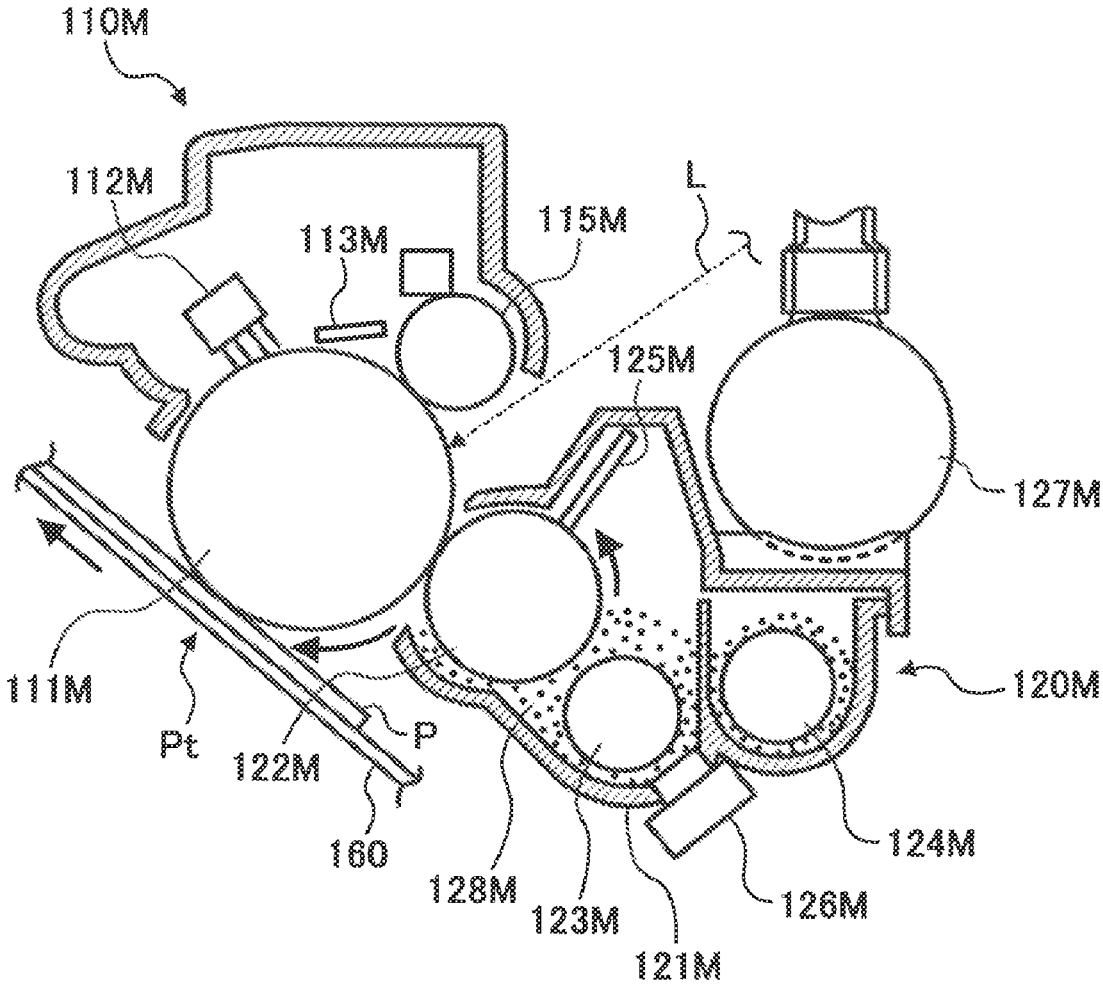
FIG. 10 is an enlarged schematic of the magenta image forming unit in a cleaning mode.

Also, if the blade 113M is made to abut on the photosensitive drum in a counter direction with respect to the moving direction of the photosensitive drum, the transfer residual toner is retained in a wedge-shaped area between the blade 113M and the photosensitive drum 111M. As a result, the transfer residual toner retained at the tip of the blade is further pressed into a narrower area by the subsequent transfer residual toner to be retained thereafter, thereby receiving a strong pressure. This may cause the transfer residual toner retained at the tip of the blade to be fixedly solidified. However, in the second embodiment, the blade 113M abuts on the trading direction with respect to the moving direction of the photosensitive drum, thereby preventing the transfer residual toner from being retained in the wedge-shaped area between the blade and the photosensitive drum. Thus, the transfer residual toner retained at the tip of the blade does not receive a strong pressure by the subsequent transfer residual toner to be retained thereafter, thereby preventing the retained transfer residual toner from being fixedly solidified. Also, with the blade 113 being made to abut in the trading direction, when the blade is separated away from the photosensitive drum at a predetermined timing as shown in FIG. 10, the blade 113 serves as a member of regulating the transfer residual toner, thereby preventing movement of a large amount of toner at a time.

The transfer residual toner retained by the blade 113M is returned to the photosensitive drum by separating the blade 113 away from the photosensitive drum at a time such as that when no latent image is formed when the transfer residual toner returned from the blade 113M to the photosensitive drum 111M passes through the latent image forming area. For example, a cleaning mode is provided at the time of starting or end of the image forming apparatus or after an image forming operation has been performed a predetermined number of times. In this cleaning mode, the blade 113 is separated away from the photosensitive drum. Alternatively, the blade may be separated away in a paper process between one image forming process and another image forming process to return the transfer residual toner to the photosensitive drum 111M.

The transfer residual toner returned at the timing described above has been made by the charging brush 112M to a uniform normally-charged toner, and therefore passes through the charging roller 115M without electrostatically adhering thereto. The transfer residual toner then passes though the latent image forming area while no latent image is being formed, and is then conveyed to the developing area opposed to the development sleeve. The development sleeve is applied with a developing bias having a polarity (positive) in reverse to the polarity at the time of development. Since the entire transfer residual toner on the photosensitive drum conveyed to the developing area has been made by the charging brush 112M to a negatively-charged toner, the transfer residual toner electrostatically adheres to a carrier on the development sleeve applied with the positive developing bias. The toner adhering to the carrier is collected by the development sleeve in the developing device. Here, the carrier for use is a carrier having a small particle diameter of 35 micrometers, which is smaller than 40 micrometers. With the use of a carrier having a small particle diameter smaller than 40 micrometers, the magnetic brush formed on the development sleeve can be made dense. Consequently, the brush can be in intimate contact with the surface of the photosensitive drum, and the number of times of contact with the surface of the photosensitive drum can also be increased. Therefore, the transfer residual toner can be more reliably collected. Also, dot reproducibility of an image portion after development can be improved.

Figure 11:
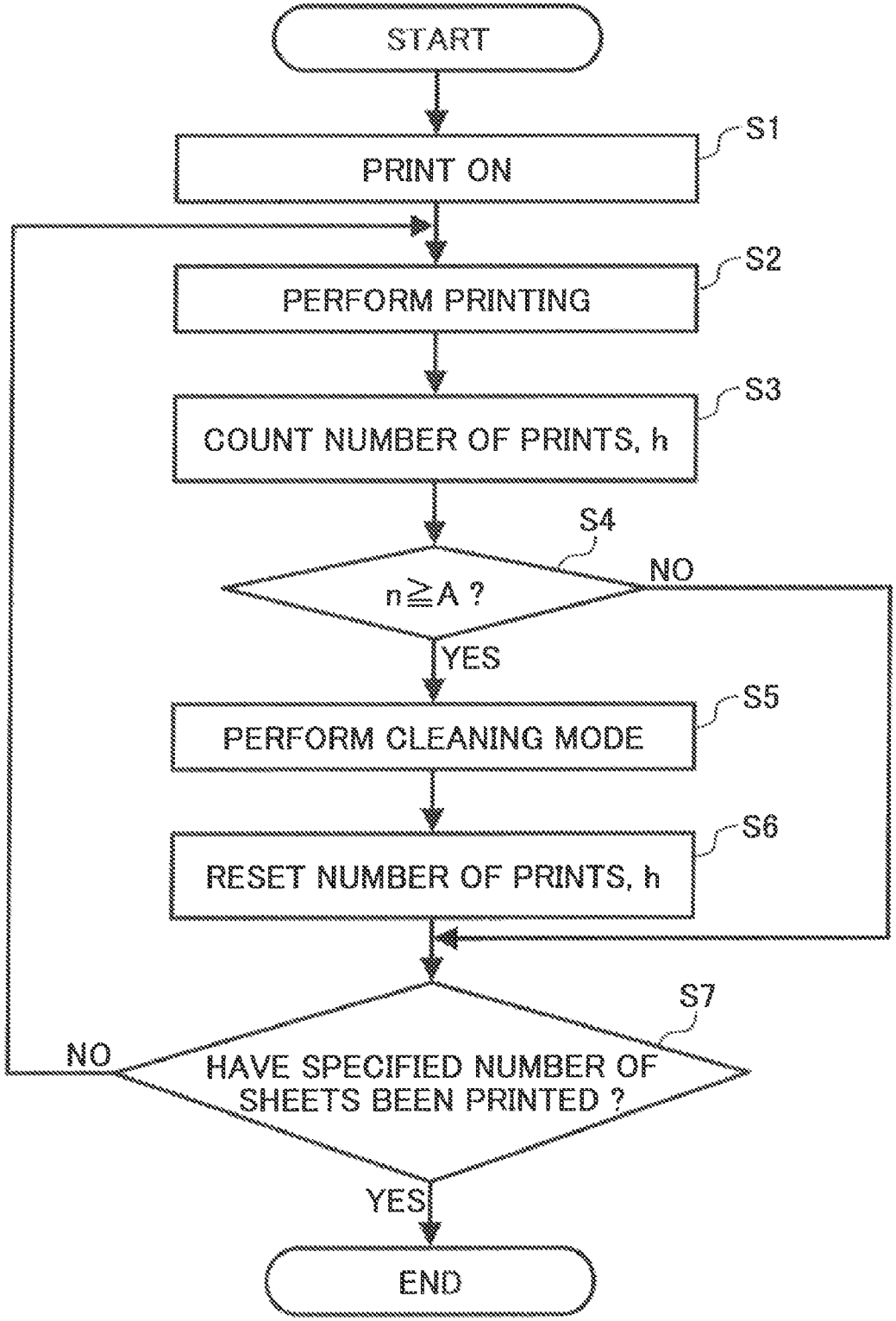
FIG. 11 is a flowchart of a timing of contact and separation of the blade.

The blade 113M is normally in contact with the photosensitive drum and, at the predetermined timing, is separated away from the surface of the photosensitive drum. FIG. 11 is a flowchart depicting a timing of contact and separation of the blade. In this flowchart, the cleaning mode is performed after the image forming operation has been performed a predetermined number of times. In FIG. 11, the number of sheets to be printed is specified to set print ON (S1) for printing (S2). The number of prints, n, is then counted (S3). When the accumulated number of prints, n, is equal to or more than a predetermined number of sheets, A, ("YES" at S4), the cleaning mode is performed (S5). When the cleaning mode is performed, the blade 113 is separated away from the photosensitive drum to return the transfer residual toner retained by the blade 113 to the surface of the photosensitive drum. Also, the developing bias applied to the development sleeve 122M is switched to a positive developing bias. Then, the photosensitive drum is rotated to cause the returned transfer residual toner to be collected in the developing device. After the photosensitive drum has been rotated a predetermined number of times (more than once), the cleaning mode ends. Upon the end of the cleaning mode, the number of prints is reset (S6). After printing has been performed for the specified number of sheets ("YES" at step S7), printing ends. On the other hand, if printing has not yet been performed for the specified number of sheets ("NO" at step S7), printing is restarted. If the number of prints is smaller than the predetermined number of sheets, A ("NO" at step S4) and if printing has not yet been performed for the specified number of prints ("NO" at step S7), printing is again performed. On the other hand, if printing has been performed for the specified number of sheets, printing ends.

In the present embodiment, the transfer residual toner is uniformly made by the charging brush 112M to a negative normally-charged toner. This is not meant to be restrictive.

The transfer residual toner may be uniformly made by the charging brush 112M to a positive reversely-charged toner. In this case, in the cleaning mode, the charging bias applied to the charging roller is set OFF to prevent the reversely-charged toner from adhering to the charging roller. Also, the developing bias applied to the development sleeve is applied with a negative voltage, thereby allowing the transfer residual toner on the photosensitive drum to be electrostatically absorbed for collection.

Also, in the present embodiment, the charging brush 112M is provided. Alternatively, the charging brush 112M may not be provided. In this case, in the cleaning mode, the charging bias and the developing bias are set OFF. The transfer residual toner on the photosensitive member is collected through contact with the carrier on the development sleeve. Furthermore, the charging brush 112M is provided on an upstream side before the blade 113M in the moving direction of the photosensitive drum. Alternatively, the order of provision may be reversed.

As described above, according to the image forming apparatus of the present embodiment, the transfer residual toner that has not been electrostatically transferred onto the transfer paper 100 but remains on the surface of the photosensitive drum 111M is temporarily retained in a mechanical manner by the blade 113M of a primary retaining unit before reaching the latent image forming area. As such, with the transfer residual toner being mechanically retained, a normally-charged toner and a reversely-charged toner can be both retained. Then, when passing through the latent image forming area, the transfer residual toner is returned to the photosensitive drum at a timing such as that when the optical writing unit 102 does not perform writing on the surface of the photosensitive drum. Thus, the transfer residual toner can be prevented from adhering to the surface of the photosensitive drum passing through the latent image forming area while the optical writing unit 102 is forming a latent image. Thus, an unexposed portion is prevented from being formed due to the transfer residual toner. As a result, white dots can be prevented from occurring on a solid image portion, thereby allowing a satisfactory image to be obtained.

Also, the blade 113M is provided on the upstream side before the charging roller 115M in the moving direction of the photosensitive drum 111M. Therefore, the moving distance of the surface of the photosensitive drum from the charging roller to the developing unit can be minimized. With this, the amount of the potential that changes while the photosensitive drum charged by the charging roller 115M reaches the developing area can be minimized, thereby allowing a satisfactory image to be obtained.

Furthermore, the blade 113M abuts on the photosensitive drum 111M while the optical writing unit 102 is in operation, that is, while a latent image is being formed, and is separated away from the photosensitive drum while the optical writing unit 102 is not in operation, that is, while no latent image is being formed. With this, the transfer residual toner is prevented from adhering to the surface of the photosensitive drum passing through the latent image area while a latent image is being formed. Therefore, an unexposed portion is prevented from being formed due to the transfer residual toner. As a result, white dots can be prevented from occurring on a solid image portion, thereby allowing a satisfactory image to be obtained.

Still further, if the blade 113M is made to abut on the photosensitive drum in a counter direction with respect to the moving direction of the photosensitive drum, the transfer residual toner is retained in a wedge-shaped area between the blade 113M and the photosensitive drum 111M. As a result, the transfer residual toner retained at the tip of the blade is further pressed into a narrower area by the subsequent transfer residual toner to be retained thereafter, thereby receiving a strong pressure. This may cause the transfer residual toner retained at the tip of the blade to be fixedly solidified. However, in the second embodiment, the blade 113M abuts on the trading direction with respect to the moving direction of the photosensitive drum 111M, thereby preventing the transfer residual toner from being retained in the wedge-shaped area between the blade 113M and the photosensitive drum 111M. Thus, the transfer residual toner retained at the tip of the blade does not receive a strong pressure by the subsequent transfer residual toner to be retained thereafter, thereby preventing the retained transfer residual toner from being fixedly solidified. Also, with the blade 113M being made to abut in the trading direction, when the blade 113M is separated away from the photosensitive drum 111M at a predetermined timing, the blade 113M serves as a member of regulating the transfer residual toner, thereby preventing movement of a large amount of toner at a time.

Still further, in the second embodiment, the transfer residual toner is uniformly charged by the charging brush 112M serving as a toner charging unit to either one of positive and negative polarities. With this, if a developing bias having a polarity reverse to the polarity of the transfer residual toner uniformly charged by the charging brush is applied, the transfer residual toner can be reliably absorbed electrostatically to the carrier of the development sleeve. With this, the transfer residual toner can be reliably collected in the developing device. Also, the charging brush 112M is provided on the upstream side before the charging roller 115M in the moving direction of the photosensitive drum to uniformly charge the transfer residual toner so that the transfer residual toner has a negative polarity, which is the same as that of the charging bias. With this, when passing through the charging area opposed to the charging roller, the transfer residual toner does not electrostatically adhere to the charging roller. Therefore, when the transfer residual toner passes through the charging area, the power supply applying power to the charging roller does not have to be set OFF.

Still further, the charging brush 112M is provided on the upstream side before the blade 113M with respect to the moving direction of the photosensitive drum. With this, the transfer residual toner retained by the blade 113M is uniformly charged to either one of positive and negative polarities. As a result, the transfer residual toner retained by the blade is prevented from being electrostatically bound together to increase the particle diameter of the toner. Thus, the transfer residual toner returned from the blade to the photosensitive drum at a predetermined timing can be prevented from getting caught between the photosensitive drum and the charging roller. Consequently, inconveniences, such as an insufficient charge, can be prevented.

Still further, with the use of a carrier having a small particle diameter smaller than 40 micrometers, the magnetic brush formed on the development sleeve can be made dense. Consequently, the brush can be in intimate contact with the surface of the photosensitive drum, and the number of times of contact with the surface of the photosensitive drum can also be increased. Therefore, the transfer residual toner can be more reliably collected. Also, dot reproducibility of an image portion after development can be improved.

Still further, with the image forming processing units, such as the charging roller and the developing device, being formed in a process cartridge, if any component incorporated in the process cartridge reaches its end of life or requires maintenance, all what is required is to replace the process cartridge. This improves convenience.

FIG. 6 is a schematic structural diagram of a printer according to the third embodiment. This printer includes four photosensitive members 201Y, 201C, 201M, and 201K. Drum-shaped photosensitive members are shown as an example, but belt-shaped photosensitive members can be adopted. In the third embodiment, each of the photosensitive members 201Y, 201C, 201M, and 201K is rotationally driven in a direction indicated by an arrow in the drawing as being in contact with an intermediate transfer belt 210, which is an non-terminated moving member as a surface moving member. Each of the photosensitive members 201Y, 201C, 201M, and 201K is formed such that a photosensitive layer is formed on a cylindrical conductive body having a relatively thin thickness and a protective layer is further formed on the photosensitive layer. Each photosensitive member has an outer diameter of 30 millimeters and an inner diameter of 28.5 millimeters. In the third embodiment, in view of low cost, design flexibility, and non-pollution, an organic photosensitive member is used.

Figure 12:
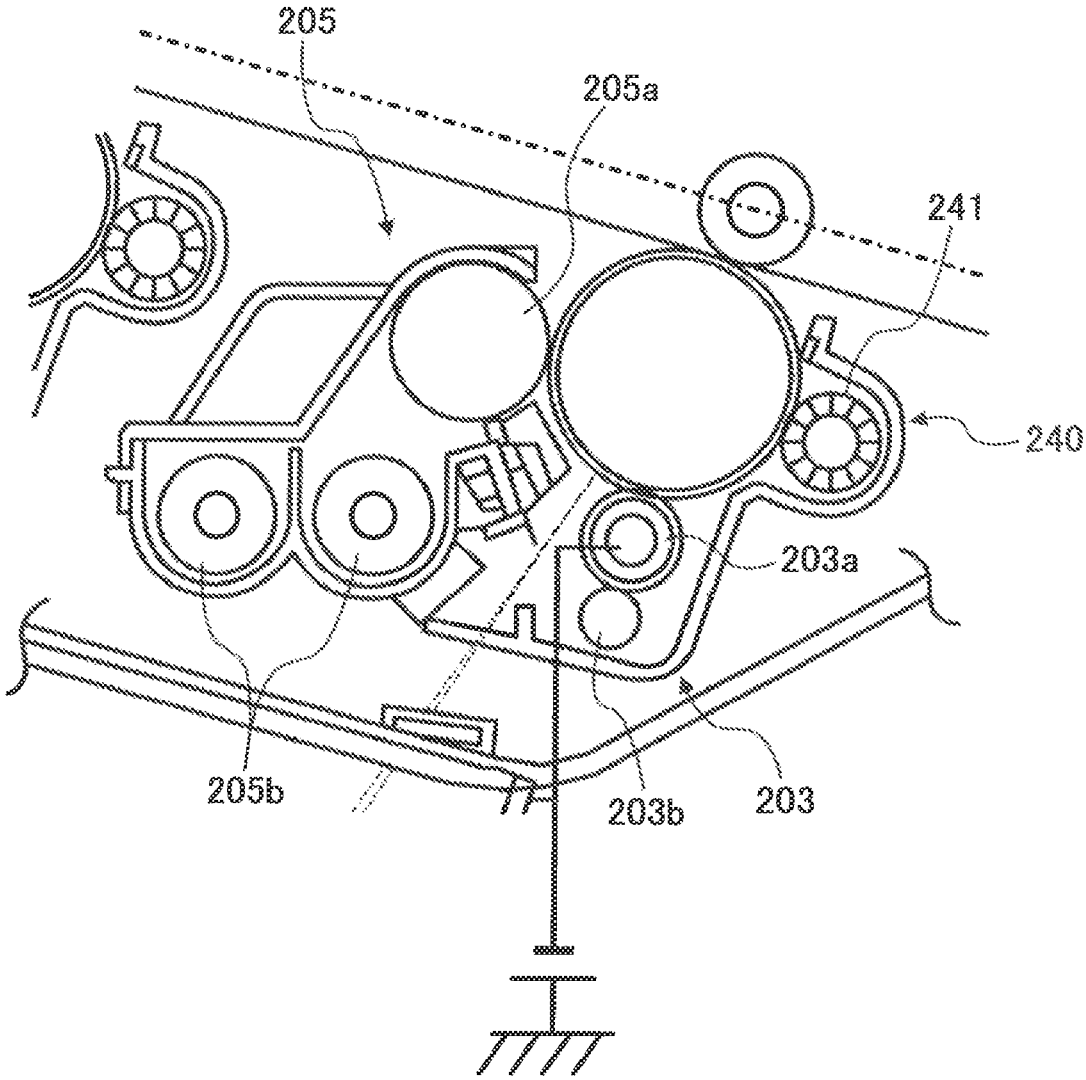
FIG. 12 is a schematic of photosensitive members according to the third embodiment.

FIG. 12 is a schematic structural diagram of the structure surrounding any one of the photosensitive members 201Y, 201C, 201M, and 201K according to the third embodiment. Since the structures surrounding the photosensitive members 201Y, 201C, 201M, and 201K are the same, only the structure surrounding one of the photosensitive members is shown, and suffixes Y, C, M, and K for color classification are omitted.

The photosensitive member 201 is surrounded by a toner retaining device 240 serving as a temporarily-retaining unit, a charging device 203 serving as a charging unit, and a developing device 205 serving as a developing unit that are disposed along a surface moving direction of the photosensitive member. Between the charging device 203 and the developing device 205, a space is secured for allowing light emitted from an exposing device 204 serving as a latent image forming unit to pass to the photosensitive member 201.

The charging device 203 uniformly charges the surface of the photosensitive member 201. The charging 203 device in the third embodiment includes a charging roller 203*a* serving as a charging member performing a charging process in a so-called contact/proximity charging scheme. That is, the charging device 203 makes the charging roller 203*a* in contact with the surface of the photosensitive member 201 and, with a negative bias being applied to the charging roller 203*a*, uniformly charges the surface of the photosensitive member 201. In the third embodiment, a direct-current charging bias of approximately −1000 volts is applied to the charging roller 203*a* so that a surface potential of the photosensitive member 201 is uniformly at −(minus) 500 volts.

On the surface of the photosensitive member 201 uniformly charged in the manner described above, an electrostatic latent image exposed by the exposing device 204 corresponding to the relevant color is formed. The exposing device 204 writes the latent image corresponding to the relevant color onto the photosensitive member 201 based on image information corresponding to the relevant color. Here, the exposing device 204 according to the third embodiment is a laser-type exposing device. Alternatively, an exposing device of another type can be adopted, such as an exposing device including an LED array and an image forming unit.

Also, in the developing device 205, a developing roller 205*a* serving as a developer carrier is partially exposed from an opening of a casing. In the developing device 205 for use in the third embodiment, a binary developer formed of a toner and a carrier is used. Alternatively, a single developer not containing a carrier may be used. The developing device 205 accommodates a toner corresponding to the relevant color supplied from one of toner bottles 231Y, 231C, 231M, and 231K shown in FIG. 6. These toner bottles 231Y, 231C, 231M, and 231K are each structured to be removable from a printer body so that each can be singly replaced. With this structure, at the time of toner end, all what is required is to replace only the relevant one of the toner bottles 231Y, 231C, 231M, and 231K. Therefore, other components that have not yet reached their end of life by the end of toner's life can be used as they are, thereby suppressing user's cost.

The toner supplied from one of the toner bottles 231Y, 231C, 231M, and 231K to the developing device 205 is mixed with the carrier by a mixing conveyor screw 205*b* for conveyance, and is then carried on the developing roller 205*a*. This developing roller 205*a* includes a magnet roller serving as a magnetic field generating unit and a development sleeve coaxially rotating thereabout. The carrier particles in the developer are conveyed to a developing area opposed to the photosensitive member 201, as being chained together on the developing roller 205*a* by magnetic force produced by the magnet roller. Here, the developing roller 205*a* makes a surface movement with a linear velocity faster than that of the surface of the photosensitive member 201 in the developing area. Then, the carrier particles chained together on the developing roller 205*a* slide on the surface of the photosensitive member 201 to supply the toner adhering to the surface of the carrier particles to the surface of the photosensitive member 201. At this time, the developing roller 205*a* is applied with a developing bias of −300 volts from a power supply not shown, thereby forming a development magnetic field in the developing area. Then, between the electrostatic latent image and the developing roller 205*a*, an electrostatic force toward the electrostatic latent image is generated on the toner on the developing roller 205*a*. With this, the toner on the developing roller 205*a* adheres to the electrostatic latent image on the photosensitive member 201. With this adherence, the electrostatic latent image on the photosensitive member 201 is developed to a toner image of the corresponding color.

The intermediate transfer belt 210 is laid across three supporting rollers 211, 212, and 213 in a tensioned condition, and is structured to move without being terminated in a direction indicated by an arrow in the drawing. On this intermediate transfer belt 210, toner images on the photosensitive members 201Y, 201C, 201M, and 201K are transferred to be superposed one another by an electrostatic transfer scheme. Some electrostatic transfer schemes use a transfer charger. In the third embodiment, however, transfer rollers, which produce less transfer dust, are used. Specifically, on the back surface of portions of the intermediate transfer belt 210 that are in contact with the photosensitive members 201Y, 201C, 201M, and 201K, primary transfer rollers 214Y, 214C, 214M, and 214K are disposed. In the third embodiment, the portions of the intermediate transfer belt 210 that are pressed by the primary transfer rollers 214Y, 214C, 214M, and 214K and the photosensitive members 201Y, 201C, 201M, and 201K form primary nip portions. Then, to transfer the toner images on the photosensitive members 201Y, 201C, 201M, and 201K onto the intermediate transfer belt 210, each primary transfer roller 214 is applied with a positive bias. With this, a transfer electric field is formed at each primary nip portion, thereby transferring the toner images on the photosensitive members 201Y, 201C, 201M, and 201K onto the intermediate transfer belt 210 so that the toner images electrostatically adhere to the intermediate transfer belt 210.

Near the intermediate transfer belt 210, a belt cleaning device 215 that removes a toner remaining on the surface of the belt is provided. This belt cleaning device 215 is structured such that an unwanted toner adhering to the surface of the intermediate transfer belt 210 is collected with a fur brush and a cleaning blade. The collected unwanted toner is conveyed by a conveyor unit not shown from out of the belt cleaning device 215 to a waste toner tank not shown.

Also, the portion of the intermediate transfer belt 210 laid across the supporting roller 213 in a tensioned condition is provided with a secondary transfer roller 216 in contact with that portion. Between the intermediate transfer belt 210 and the secondary transfer roller 216, a secondary transfer nip portion is formed, where transfer paper as a recording member is fed at a predetermined timing. This transfer paper is accommodated in a paper feeding cassette 220, and is conveyed by a paper feeding roller 221 and paired resist rollers 222, and others to the secondary transfer nip portion. Then, the toner images superposed one another on the intermediate transfer belt 210 are collectively transferred on the transfer paper at the secondary transfer nip portion. At this secondary transfer, a positive bias is applied to the secondary transfer roller 216, thereby forming a transfer electric field. With this transfer electric field, the toner image on the intermediate transfer belt 210 is transferred onto the transfer paper.

On a downstream side in a transfer-paper conveying direction of the secondary transfer nip portion, a heating and fixing device 223 serving as a fixing unit is disposed. This heating and fixing device 223 includes a heating roller 223*a* having incorporated therein a heater and a pressure roller 223*b* for applying a pressure. The transfer paper passing through the secondary transfer nip portion is pinched between these rollers for heating and pressuring. With this, the toner on the transfer paper is melted to cause the toner image to be fixed on the transfer paper. Then, the transfer paper after fixing is delivered by a paper delivery roller 224 to a paper delivery tray on the upper surface of the apparatus.

In the third embodiment, the photosensitive members 201Y, 201C, 201M, and 201K, components surrounding these photosensitive members, such as the developing devices, the exposing device 204, the intermediate transfer belt 210, the belt cleaning device 215, and others are integrally formed in a process cartridge 230. This process cartridge 230 is removable from a printer body. Therefore, if any component incorporated in the process cartridge 230 reaches its end of life or requires maintenance, all what is required is to replace the process cartridge 230. This improves convenience. Also, in the third embodiment, the toner bottles 231Y, 231C, 231M, and 231K are provided separately from the process cartridge 230 and are removable from the printer body.

Next, description is made to a feature of the present invention, that is, cleaning of the transfer residual toner remaining on the surface of the photosensitive members 201Y, 201C, 201M, and 201K. FIG. 2A is a graph of charge potential distribution immediately before transfer of the toner carried on the photosensitive member 201. FIG. 2B is a graph of charge potential distribution of a transfer residual toner remaining on the photosensitive member 201 after transfer. As shown in FIG. 2A, the amount of charge of the toner immediately before transfer is distributed centering on approximately −30 μC/g, and most of the toner has a normal negative charge. On the other hand, the amount of charge of the transfer residual toner is distributed centering on −2 μC/g. In general, most of the transfer residual toner does not have a desired charge because of, for example, a defect in toner's composition. Thus, part of the transfer residual toner is injected with a charge by a positive bias applied to the primary transfer roller 214, and the charge polarity of the toner is reversed to positive. As a result, the transfer residual toner includes a reversely-charged toner, as shown in a diagonally-shaded area of FIG. 2B, with its polarity being reversed to positive.

The transfer residual toner in which a normally-charged toner $T_0$ charged with −20 μC/g to −5 μC/g and a reversely-charged toner $T_1$ reversed to positive are mixed is temporarily retained by the toner retaining device 240.

Figure 13:
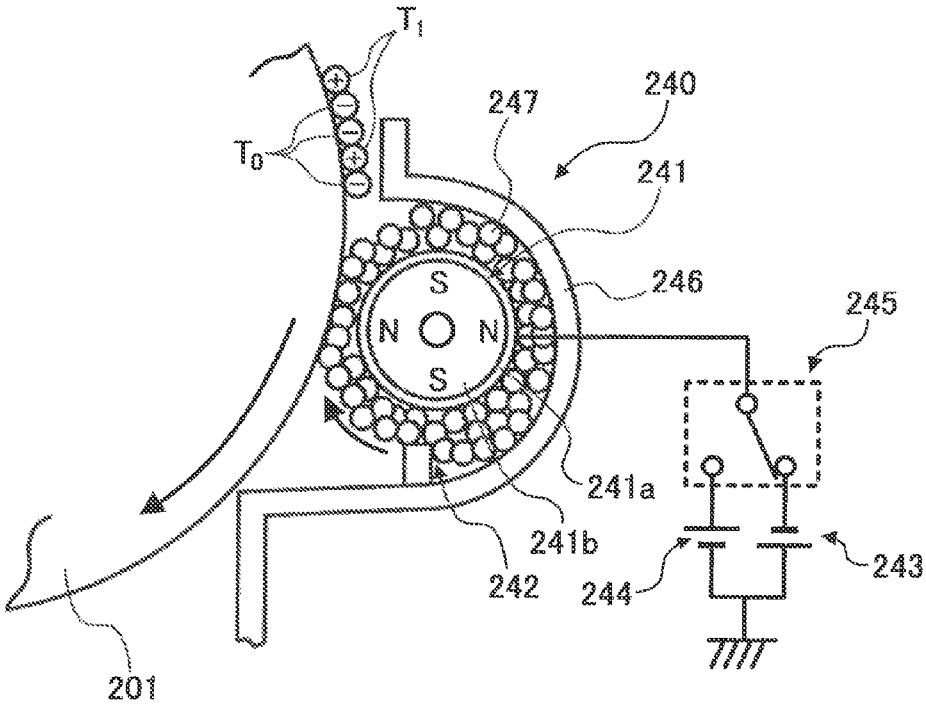
FIG. 13 is a schematic of a toner retaining device according to the third embodiment.

FIG. 13 is a schematic structural diagram of the toner retaining device 240 according to the third embodiment. The toner retaining device 240 includes a magnetic brush roller 241. The magnetic brush roller 241 includes a rotating sleeve 241*a* and a magnet roller 241*b* having a diameter of 10 millimeters and serving as a magnetic field generating unit fixedly disposed inside the rotating sleeve 241*a*. The rotating sleeve 241*a* is made of a conductive and non-magnetic material, and is provided on its outer edge surface with V-shaped grooves with 0.8-millimeter pitches and with a depth of 0.2 millimeters. The rotating sleeve 241*a* is rotated by a driving device not shown, clockwise in the drawing similarly to the photosensitive member 201 at a velocity faster than the photosensitive member 201. The rotation velocity of the rotating sleeve 241*a* is preferably 1.0 to 3.0 times as fast as the rotation velocity of the photosensitive member 201 and, more preferably, 1.5 to 2.0 times. Inside the magnet roller 241*b*, N-pole magnets and S-pole magnets are alternately disposed. Also, in the toner retaining device 240, a casing 246 is provided for accommodating magnetic particles (carrier) 247. The rotating sleeve 241*a* and the photosensitive member 201 has a gap therebetween of 0.4 to 0.5 millimeters. Also, a contact width (retaining nip) between the magnetic brush and the photosensitive member is set to be 5 to 6 millimeters.

In the third embodiment, the structure in which a blade is made to abut on the surface of the photosensitive member 201 is not adopted. Therefore, compared with the case where the blade is made to abut, load torque on the driving device for the photosensitive member 201 can be significantly reduced. On the other hand, however, retaining capability of retaining the transfer residual toner remaining on the surface of the photosensitive member 201 is low. Therefore, as the device is being used for a long time, a filming phenomenon may occur in which a film-like additive liberated from the toner strongly adheres to the surface of the photosensitive drum 201. Although the amount of such transfer residual toner as described above can be relatively reduced by using a so-called round toner as a toner for use, even with such a round toner, a filming phenomenon may occur if such a toner is used for a long time. However, in the third embodiment, as described above, the magnetic brush roller 241 is driven in a direction in reverse to the surface of the photosensitive member 201. Therefore, compared with the case where the magnetic brush roller 241 goes along the surface of the photosensitive member 201 and the case where the magnetic brush roller 241 is driven in the same direction as that of the surface of the photosensitive drum 201, the present embodiment can achieve an operation of more scraping the additive of the toner adhering to the surface of the photosensitive member 201. Consequently, the occurrence of a filming phenomenon can be prevented.

The magnetic brush roller 241 is applied with a bias from either one of a first power supply 243 and a second power supply 244. Specifically, a switch 245 is provided between these power supplies 243 and 244 and the brush roller 241. With an operation of this switch 245, a power supply to be connected to the brush roller 241 is selected. The operation of the switch 245 is controlled by a controlling unit of the printer. In the third embodiment, the first power supply 243 applies a retaining bias so that the surface of the brush roller 241 has a potential of −50 volts, while the second power supply 244 applies an emission bias so that the surface of the brush roller 241 has a potential of −350 volts. Also, the toner retaining device 240 includes a blade 242 that regulates a layer thickness of the magnetic brush. The blade 242 is disposed to form a gap of 0.6 to 0.8 millimeters with the rotating sleeve.

As the carrier particles 247 of the retaining device 240, the same carrier particles as those accommodated in the developing device 205 are used. The carrier particles 247 have an average particle diameter of 50 micrometers coated with silicone resin for negatively-charged toners and a low- to intermediate-resistance of $10^6$ to $10^{12}$ ohm centimeters. The resistance value of the carrier particles 247 is measured by disposing electrode plates of 4×5 (millimeters) 2 millimeters apart from each other, filling the carrier particles between the plates, and using a 100-volt applying scheme. As such, in the third embodiment, the magnetic brush is formed by using carrier particles having a low- to intermediate-resistance. Therefore, compared with a fur brush roller, the electric field of the tip of the brush can be easily reversed.

The carrier 247 accommodated in the casing 246 is conveyed on the rotating sleeve 241*a* to the photosensitive member 201. At this time, with the magnetic field of the magnet roller 241*b*, the carrier particles 247 are chained together to form a magnetic brush. The layer thickness of this magnetic brush is controlled by the blade 242 to be uniform in an axial direction of the rotating sleeve 241*a*. Then, this magnetic brush slides on the surface of the photosensitive member to retain the transfer residual toner adhering to the photosensitive member. At this time, the magnetic brush is applied with a retaining bias from the first power supply 243. The retaining bias is applied with a voltage approximately equal to the potential of the photosensitive member after transfer (−50 to −100 volts). With this, no potential difference occurs between the photosensitive member 201 and the magnetic brush roller 241. Therefore, an electrostatic absorption force, which is caused by a potential difference between the photosensitive member and the magnetic brush roller 241, does not occur on the transfer residual toner. As a result, with friction of the magnetic brush, the transfer residual toner can be retained irrespectively of the polarity of the transfer residual toner.

Also, upon examination of the amount of charge on the transfer residual toner retained by the magnetic brush, the amount of charge was −10 to −15 μC/g on the average, with its amount of negative charge being increased compared with the amount of charge on the transfer residual toner after transfer (−2 μC/g). Also, the transfer residual toner retained by the magnetic brush became the normally-charged toner $T_0$. This is because, when the transfer residual toner is retained by the magnetic brush from the surface of the photosensitive member, the transfer residual toner is charged by friction by the magnetic brush. Therefore, of the transfer residual toner, the reversely-charged toner $T_1$ having a positive polarity is reversed by friction with the magnetic brush to be the normally-charged toner $T_0$ having a negative polarity. Similarly, of the transfer residual toner, the normally-charged toner $T_0$ having a negative polarity also has the amount of negative charge increased by friction with the magnetic brush. As a result, compared with the amount of charge on the transfer residual toner after transfer, the amount of negative charge on the transfer residual toner retained by the magnetic brush is increased.

As such, the transfer residual toner retained by the magnetic brush is returned to the surface of the photosensitive member at a predetermined timing. Specifically, the switch 245 is switched from the first power supply 243 to the second power supply 244 at the predetermined timing to apply an emission bias of −350 volts to the magnetic brush roller 241. With that, a potential difference occurs between the photosensitive member 201 (approximately −50 volts) and the magnetic brush roller 241 (−350 volts). Consequently, the transfer residual toner normally charged to negative by friction is electrostatically absorbed in the photosensitive member, which has a potential higher than that of the magnetic brush. With this, the transfer residual toner retained by the magnetic brush is retuned to the photosensitive member.

Switching of the switch 245 is performed at a timing such as that when no latent image is formed when the transfer residual toner returned from the magnetic brush to the photosensitive member 201 passes through the latent image forming area. For example, when the rear end of the image portion formed in one image forming process on the photosensitive member reaches the retaining nip, the switch 245 is switched from the first power supply 243 to the second power supply 244 to apply an emission bias to the magnetic brush. Then, when the surface portion of the photosensitive member 201 to be uniformly charged by the charging device 203 in the next image forming process reaches the retaining nip, the switch 245 is switched from the second power supply 244 to the first power supply 243. With this, the voltage applied to the magnetic brush is changed from an emission bias to a retaining bias, thereby causing the transfer residual toner retained by the magnetic brush to stop emission to the photosensitive member. With the switch 245 being switched at such a timing as described above, no transfer residual toner is present on the surface of the photosensitive member while the exposing device 204 is forming a latent image on the surface of the photosensitive member. Consequently, it is possible to prevent an unexposed portion from being formed due to the transfer residual toner and to prevent image degradation, such as white dots occurring on a black solid image portion.

Also, a cleaning mode may be provided at the time of starting or end of the image forming apparatus or after an image forming operation has been performed a predetermined number of times. In this cleaning mode, the switch 245 is switched to the second power supply 244. Since no image is formed in this cleaning mode, the transfer residual toner emitted from the magnetic brush does not form an unexposed portion.

The transfer residual toner returned from the magnetic brush roller 241 passes through an area in contact with the charging roller 203*a*. At this time, the transfer residual toner has become a normally-charged toner having the same polarity as that of the charging bias, and therefore passes through the charging roller 203*a* without adhering thereto. The transfer residual toner passing the area in contact with the charging roller 203*a* further passes the latent image forming area. At this time, the exposing device 204 is not in operation, and no latent image is being formed on the surface of the photosensitive member. Then, the transfer residual toner moves to the developing area. The developing roller 205*a* is applied with a bias, that is, a bias of +200 volts, in reverse to the developing bias required for image formation. With this, in the negatively-charged transfer residual toner, an electrostatic force is generated toward the developing roller in the developing area. As a result, the transfer residual toner is electrostatically absorbed on the developing roller and is then collected by the developing device 205. The transfer residual toner collected by the developing roller in the developing device 205 is agitated and conveyed therein, and then again contributes to development.

In the third embodiment, the photosensitive members 201Y, 201C, 201M, and 201K, the components surrounding these photosensitive members, such as the developing devices, the exposing device 204, the intermediate transfer belt 210, the belt cleaning device 215, and others are integrally formed in the process cartridge 230. This is not meant to be restrictive. As shown in FIG. 12, the photosensitive members and the components surrounding these photosensitive members, such as the developing devices, the exposing device 204, and the retaining device 240 may be integrally formed in a process cartridge for each color.

As described above, according to the cleaning system of the third embodiment, the transfer residual toner that has not been electrostatically transferred by the primary transfer nip on the intermediate transfer belt 210 and remains on the surface of the photosensitive member 201 is temporarily retained by the toner retaining device 240 before reaching the latent image forming area. When passing through the latent image forming area, the transfer residual toner is returned from the retaining device 240 to the surface of the photosensitive member at a timing such as that when the exposing device 204 does not perform writing on the surface of the photosensitive member. Then, while no latent image is being formed, the transfer residual toner passes through the latent image area to be collected by the developing device. With this, the transfer residual toner is prevented from adhering to the surface of the photosensitive member passing through the latent image forming area while the exposing device 204 is forming a latent image. Thus, an unexposed portion is prevented from being formed due to the transfer residual toner, and the transfer residual toner can be collected by the developing device. As a result, white dots can be prevented from occurring on a solid image portion, thereby allowing a satisfactory image to be obtained.

Also, the transfer residual toner is temporarily retained by the magnetic brush roller 241. In the magnetic brush roller 241, the brush can be made denser compared with a fur brush roller. Therefore, the number of times of contact with the transfer residual toner on the photosensitive member is increased, thereby reliably retaining the transfer residual toner with the magnetic brush. Also, with an increase in the number of times of contact between the magnetic brush and the transfer residual toner, the transfer residual toner is further charged by friction. This friction with the magnetic brush can increase the amount of negative charge on the transfer residual toner or can reverse the polarity in a manner such that a reversely-charged toner is changed to a normally-charged toner. Furthermore, the carrier forming a magnetic brush includes various types, such as a carrier coat easily charging a toner by friction. Such a carrier can be used as the carrier 247 for the retaining device 240. With this, it is possible to achieve effects of increasing the amount of negative charge on the transfer residual toner by friction with the magnetic brush and reversing the polarity in a manner such that a reversely-charged toner is changed to a normally-charged toner. Therefore, the transfer residual toner returned to the surface of the photosensitive member at the timing described above is a normally-charged toner having the same polarity as that of the charging bias, and can therefore pass through the charging roller 203*a* without adhering thereto. Still further, compared with a fur brush, the magnetic brush can easily reverse the direction of the magnetic field between the photosensitive member and the tip of the brush.

Furthermore, in the third embodiment, while the exposing device 204 is in operation, a retaining bias having a potential approximately equal to the surface potential of the photosensitive member after transfer is applied by the first power supply 243. With this, no potential difference occurs between the magnetic brush and the surface of the photosensitive member. Therefore, the normally-charged toner having a negative potential and the reversely-charged toner having a positive potential are prevented from being electrostatically absorbed in the surface of the photosensitive member. As a result, the transfer residual toner can be reliably retained by a friction force of the magnetic brush. Thus, the transfer residual toner is prevented from adhering to the surface of the photosensitive member passing through the latent image forming area while the exposing device 204 is forming a latent image, Then, while the exposing device 204 is not in operation, that is, while no image is being formed, the switch 245 serving as a selecting unit is switched from the first power supply 243 to the second power supply 244. With this, the magnetic brush is applied with an emission bias having a minus polarity, which is the same as that of the surface of the photosensitive member after transfer, and having a potential (350 volts) larger than an absolute value (50 volts) of the surface potential of the photosensitive member after transfer. Then, a potential difference occurs between the surface of the photosensitive member and the magnetic brush. The transfer residual toner retained by the magnetic brush has been charged by friction with the magnetic brush to uniformly become a normally-charged toner. Therefore, the transfer residual toner retained by the magnetic brush is emitted from the magnetic brush to be electrostatically absorbed in the surface of the photosensitive member, which has a high potential. With this, the transfer residual toner at the magnetic brush can be returned to the surface of the photosensitive member. As such, with the transfer residual toner retained by the retaining device 240 being returned to the surface of the photosensitive member while no image is being formed, the transfer residual toner can pass through the latent image forming area while the exposing device 204 is not in operation.

Still further, in the third embodiment, while an image is being formed, the transfer residual toner is retained by the retaining device 240 to be prevented from passing through the latent image forming area. Then, while no image is being formed, the transfer residual toner passes through the latent image forming area to be collected by the developing unit. With this, the transfer residual toner can be collected by the developing unit without forming an unexposed portion due to the transfer residual toner. As a result, white dots are prevented from occurring on a solid image portion, thereby obtaining a satisfactory image.

Still further, in the third embodiment, the rotating sleeve 241*a* rotates in the same direction as that of the photosensitive member 201. With this, at a position where the rotating sleeve 241*a* and the photosensitive member 201 are opposed to each other, the surface of the rotating sleeve 241*a* moves in a direction in reverse to the moving direction of the surface of the photosensitive member. As a result, a large number of tips of the magnetic brush are in contact with the surface of the photosensitive member while the photosensitive member passes through the retaining nip. Therefore, the transfer residual toner retained on the surface of the photosensitive member can be reliably retained. Also, with an increase in the number of times of contact between the magnetic brush and the transfer residual toner, the transfer residual toner is further charged by friction. Therefore, it is possible to reliably reverse the polarity in a manner such that a reversely-charged toner is changed to a normally-charged toner.

Still further, compared with the case where the magnetic brush roller 241 goes along the surface of the photosensitive member 201 and the case where the magnetic brush roller 241 is driven in the same direction as that of the surface of the photosensitive drum 201, the present embodiment can achieve an operation of more scraping the additive of the toner adhering to the surface of the photosensitive member 201. Consequently, the occurrence of a filming phenomenon can be prevented.

Still further, with the components being formed in a process cartridge, if any component incorporated in the process cartridge 230 reaches its end of life or requires maintenance, all what is required is to replace the process cartridge 230. This improves convenience.

The basic structure is the same as that of the third embodiment, and therefore only the difference is described in detail. In the fourth embodiment, description is made to an image forming method using a negative/positive scheme in which a charge of an image portion is eliminated on a photosensitive member and a toner is made by a developing bias to adhere to a portion without charge. This is not meant to be restrictive, and a positive/positive image forming scheme may be used.

Also in the fourth embodiment, the transfer residual toner in which a normally-charged toner $T_0$ charged with −20 μC/g to −5 μC/g and a reversely-charged toner $T_1$ reversed to positive are mixed is temporarily retained by the toner retaining device 240.

Figure 14:
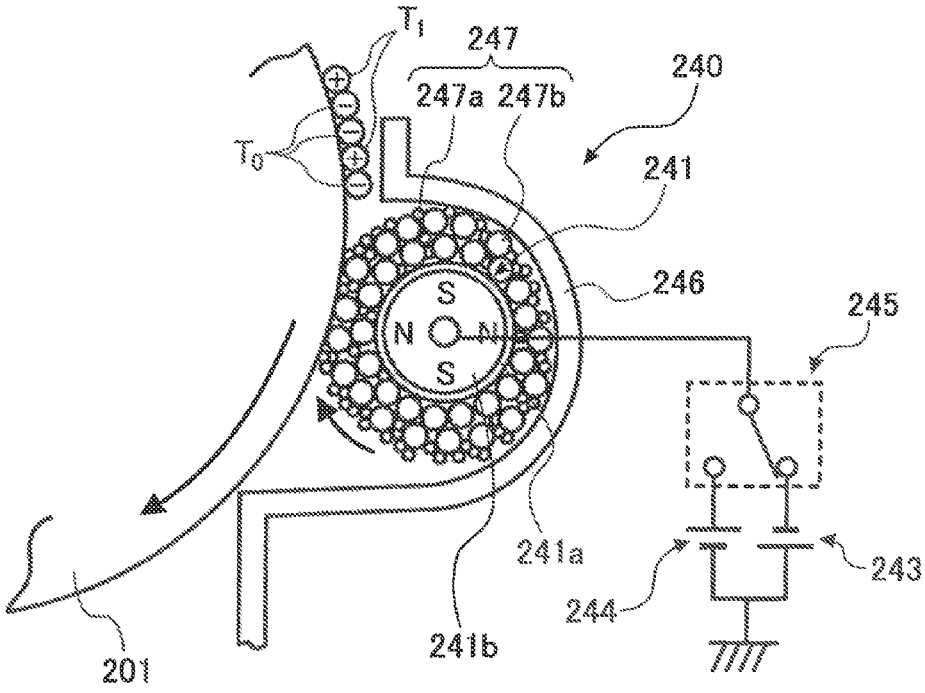
FIG. 14 is a schematic of a toner retaining device according to a fourth embodiment of the present invention.

FIG. 14 is a schematic structural diagram of the toner retaining device 240 according to the fourth embodiment. The toner retaining device 240 includes a magnetic brush roller 241. The magnetic brush roller 241 includes a rotating sleeve 241*a* and a magnet roller 241*b* serving as a magnetic field generating unit fixedly disposed inside the rotating sleeve 241*a*. The rotating sleeve 241*a* is driven by a driving device not shown clockwise in the drawing similarly to a photosensitive member 214. With this, at a position where the rotating sleeve 241*a* and the photosensitive member 214 are opposed to each other, the surface of the rotating sleeve 241*a* moves in a direction in reverse to the moving direction of the surface of the photosensitive member. As a result, a large number of tips of the magnetic brush are in contact with the surface of the photosensitive member while the photosensitive member is passing through the retaining nip. Therefore, the transfer residual toner adhering to the surface of the photosensitive member can be reliably retained. Also, with an increase in the number of times of contact between the magnetic brush and the transfer residual toner, the transfer residual toner is further charged by friction. Therefore, it is possible to reliably reverse the polarity in a manner such that a reversely-charged toner is changed to a normally-charged toner. Inside the magnet roller 241*b*, N-pole magnets and S-pole magnets are alternately disposed. Also, in the toner retaining device 240, the casing 246 is provided for accommodating the magnetic particles (carrier) 247. Also, a contact width (retaining nip) between the magnetic brush and the photosensitive member is set to be 5 to 6 millimeters.

In the fourth embodiment, the structure in which a blade is made to abut on the surface of the photosensitive member 214 is not adopted. Therefore, compared with the case where the blade is made to abut, load torque on the driving device for the photosensitive member 214 can be significantly reduced. On the other hand, however, retaining capability of retaining the transfer residual toner remaining on the surface of the photosensitive member 214 is low. Therefore, as the device is being used for a long time, a filming phenomenon may occur in which a film-like additive liberated from the toner strongly adheres to the surface of the photosensitive drum 201. Although the amount of such transfer residual toner as described above can be relatively reduced by using a round toner as a toner for use, even with such a round toner, a filming phenomenon may occur if such a toner is used for a long time. However, in the fourth embodiment, as described above, the magnetic brush roller 241 is driven in a direction in reverse to the surface of the photosensitive member 214. Therefore, compared with the case where the magnetic brush roller 241 goes along the surface of the photosensitive member 201 and the case where the magnetic brush roller 241 is driven in the same direction as that of the surface of the photosensitive member 214, the present embodiment can achieve an operation of more scraping the additive of the toner adhering to the surface of the photosensitive member 214. Consequently, the occurrence of a filming phenomenon can be prevented.

The magnetic brush roller 241 is applied with a bias from either one of the first power supply 243 and the second power supply 244. Specifically, the switch 245 is provided between these power supplies 243 and 244 and the brush roller 241. With an operation of this switch 245, a power supply to be connected to the brush roller 241 is selected. The operation of the switch 245 is controlled by a controlling unit of the printer. In the fourth embodiment, the first power supply 243 applies a retaining bias so that the surface of the brush roller 241 has a potential of −50 to 100 volts, while the second power supply 244 applies an emission bias so that the surface of the brush roller 241 has a potential of −300 to 400 volts.

The carrier 247 of the retaining device 240 is a carrier for minus toners manufactured through a known scheme by coating ferrite or magnetite with silicone resin to improve the electrostatic property to the toner and the durability of the carrier. The carrier 247 of the retaining device 240 includes small carrier particles 247*a* having an average particle diameter of 20 to 50 micrometers and large carrier particles 247*b* having an average particle diameter of 70 to 100 micrometers.

The carrier 247 accommodated in the casing 246 is carried and conveyed on the rotating sleeve 241*a* to the photosensitive member 214. At this time, with the magnetic field of the magnet roller 241*b*, the carrier particles 247 are chained together to form a magnetic brush. In this magnetic brush, the carrier particles 247*b* having a large average particle diameter of 70 to 100 micrometers are each attached with and surrounded by the carrier particles 247*a* having a small average particle diameter of 20 to 50 micrometers. These carrier particles 247*a* having a small particle diameter slide in intimate contact with the surface of the photosensitive member to retain the transfer residual toner adhering to the photosensitive member. Furthermore, with a magnetic force of the carrier particles 247*b* having a large particle diameter, the carrier particles 247*a* having a small particle diameter can be reliably retained. Therefore, the carrier particles 247*a* having a small particle diameter are prevented from being scattered to adhere to the surface of the photosensitive member. Consequently, it is possible to prevent an unexposed portion from being formed due to the transfer residual toner or the scattered carrier, and to prevent image degradation, such as white dots occurring on a solid portion.

At this time, the magnetic brush is applied with a retaining bias from the first power supply 243. The retaining bias is applied with a voltage approximately equal to the potential of the photosensitive member after transfer (−50 to −100 volts). With this, no potential difference occurs between the photosensitive member 214 and the magnetic brush roller 241. Therefore, an electrostatic absorption force, which is caused by a potential difference between the photosensitive member and the magnetic brush roller 241, does not occur on the transfer residual toner. As a result, with friction of the magnetic brush, the transfer residual toner can be retained irrespectively of the polarity of the transfer residual toner.

Furthermore, by using a magnetic toner, with the magnetic force of the magnetic brush, the transfer residual toner can be reliably retained by the magnetic brush. In particular, a black toner has a low light transmittance than that of a color toner. Therefore, when a latent image is formed with a black toner adhering to the surface of the photosensitive member, the charge on the surface of the photosensitive member is hard to be eliminated because the black toner has a light transmittance lower than that of the color toner, compared with the case where a latent image is formed with a color toner adhering to the surface of the photosensitive member. As a result, white dots formed on a solid portion due to adherence of the black toner are more conspicuous than white dots formed on the solid portion due to adherence of the color toner. Therefore, only with at least the black toner being used as a magnetic toner, white dots on the solid portion are inconspicuous, thereby preventing image degradation.

The magnetic toner can be obtained by adding any known magnetic fine powder, such as iron oxide, magnetite, and ferrite, to the toner. The amount of addition of the magnetic material is 5 to 60 weight percent and, preferably, 15 to 45 weight percent.

Still further, upon examination of the amount of charge on the transfer residual toner retained by the magnetic brush, the amount of charge was −10 to −15 μC/g on the average, with its amount of negative charge being increased compared with the amount of charge on the transfer residual toner after transfer (−2 μC/g). Also, the transfer residual toner retained by the magnetic brush became the normally-charged toner $T_0$. This is because, when the transfer residual toner is retained by the magnetic brush from the surface of the photosensitive member, the transfer residual toner is charged by friction by the magnetic brush. Therefore, of the transfer residual toner, the reversely-charged toner $T_1$ having a positive polarity is reversed by friction with the magnetic brush to be the normally-charged toner $T_0$ having a negative polarity. Similarly, of the transfer residual toner, the normally-charged toner $T_0$ having a negative polarity also has the amount of negative charge increased by friction with the magnetic brush. As a result, compared with the amount of charge on the transfer residual toner after transfer, the amount of negative charge on the transfer residual toner retained by the magnetic brush is increased.

As such, the transfer residual toner retained by the magnetic brush is returned to the surface of the photosensitive member at the predetermined timing. Specifically, the switch 245 is switched from the first power supply 243 to the second power supply 244 at the predetermined timing to apply an emission bias of −350 volts to the magnetic brush roller 241. With that, a potential difference occurs between the photosensitive member 214 (approximately −50 volts) and the magnetic brush roller 241 (−350 volts). Consequently, the transfer residual toner normally charged to negative by friction is electrostatically absorbed in the photosensitive member, which has a potential higher than that of the magnetic brush. With this, the transfer residual toner retained by the magnetic brush is retuned to the photosensitive member.

Switching of the switch 245 is performed at a timing such as that when no latent image is formed when the transfer residual toner returned from the magnetic brush to the photosensitive member 214 passes through the latent image forming area. For example, when the rear end of the image portion formed in one image forming process on the photosensitive member reaches the retaining nip, the switch 245 is switched from the first power supply 243 to the second power supply 244 to apply an emission bias to the magnetic brush. Then, when the surface portion of the photosensitive member 214 to be uniformly charged by the charging device 203 in the next image forming process reaches the retaining nip, the switch 245 is switched from the second power supply 244 to the first power supply 243. With this, the voltage applied to the magnetic brush is changed from an emission bias to a retaining bias, thereby causing the transfer residual toner retained by the magnetic brush to stop emission to the photosensitive member. With the switch 245 being switched at such a timing as described above, no transfer residual toner is present on the surface of the photosensitive member when a latent image is formed by the exposing device 204 on the surface of the photosensitive member. Consequently, it is possible to prevent an unexposed portion from being formed due to the transfer residual toner and to prevent image degradation, such as white dots occurring on a solid image portion.

Also, a cleaning mode may be provided at the time of starting or end of the image forming apparatus or after an image forming operation has been performed a predetermined number of times. In this cleaning mode, the switch 245 is switched to the second power supply 244. Since no image is formed in this cleaning mode, the transfer residual toner emitted from the magnetic brush does not form an unexposed portion.

The transfer residual toner returned from the magnetic brush roller 241 passes through an area in contact with the charging roller 203*a*. At this time, the transfer residual toner has become a normally-charged toner having the same polarity as that of the charging bias, and therefore passes through the charging roller 203*a* without adhering thereto. The transfer residual toner passing the area in contact with the charging roller 203*a* further passes the latent image forming area. At this time, the exposing device 204 is not in operation, and no latent image is being formed on the surface of the photosensitive member. Then, the transfer residual toner moves to the developing area. The developing roller 205*a* is applied with a bias, that is, a bias of +200 volts, in reverse to the developing bias required for image formation. With this, in the negatively-charged transfer residual toner, an electrostatic force is generated toward the developing roller in the developing area. As a result, the transfer residual toner is electrostatically absorbed on the developing roller and is then collected by the developing device 205. The transfer residual toner collected by the developing roller in the developing device 205 is agitated and conveyed therein, and then again contributes to development.

In the fourth embodiment, the photosensitive members 214Y, 214C, 214M, and 214K, the components surrounding these photosensitive members, such as the developing devices, the exposing device 204, the intermediate transfer belt 210, the belt cleaning device 215, and others are integrally formed in a process cartridge 230. This is not meant to be restrictive. As shown in FIG. 12, the photosensitive members and the components surrounding these photosensitive members, such as the developing devices, the exposing device 204, and the retaining device 240 may be integrally formed in a process cartridge for each color.

Next, by varying the weight percent of the carrier particles 247*a* having a smaller particle diameter and the weight percent the carrier particles 247*b* having a large particle diameter of the retaining device 240, a degree of image degradation was examined. The degree of image degradation was determined by printing five A4 sheets of a black solid image and visually observing the number of white dots. If an average number of white dots per sheet is equal to or larger than 10, a cross was marked. If the average number of white dots per sheet is smaller than 10, a circle was marked. Also, an average particle diameter of the small carrier particles 247*a* was taken as 30 micrometers, while an average particle diameter of the large carrier particles 247*b* was taken as 80 micrometers.

Furthermore, the carrier is a carrier for minus toners that is manufactured through a known scheme by coating ferrite or magnetite with silicone resin to improve the electrostatic property to the toner and the durability of the carrier. Still further, a minimum particle diameter of the carrier 247 was 25 micrometers, while a maximum particle diameter thereof was 100 micrometers. The results are shown as follows.

TABLE 3

| NO. | WEIGHT PERCENTAGE OF 30 MICROMETERS | WEIGHT PERCENTAGE OF 80 MICROMETERS | NUMBER OF WHITE DOTS PER A4 (BLACK SOLID IMAGE) | DECISION |
|---|---|---|---|---|
| 1 | 0 wt % | 100 wt % | 28.5 | X |
| 2 | 20 wt % | 80 wt % | 8.6 | ○ |
| 3 | 40 wt % | 60 wt % | 3.4 | ○ |
| 4 | 60 wt % | 40 wt % | 6.5 | ○ |
| 5 | 80 wt % | 20 wt % | 20.4 | X |
| 6 | 100 wt % | 0 wt % | 42.5 | X |

As evident from Table 3, as for a carrier No. 1 including only the large carrier particle 247*b* of 80 micrometers, an average number of white dots was 28.5, and a degraded image was observed. Also, a white line portion was observed in the image. A possible reason for this is as follows. Since the particle diameter of the carrier is large, particles of the magnetic brush on the rotating sleeve are sparsely present. Therefore, the magnetic brush cannot be in intimate contact with the surface of the photosensitive member. As a result, the number of times of contact with the magnetic brush until the surface of the photosensitive member passes through the retaining nip is small, thereby making it impossible to sufficiently collecting the transfer residual toner. Thus, the transfer residual toner passes through the latent image forming area as much adhering to the surface of the photosensitive member, thereby producing many white dot portions on the black solid image. Also, portions where the transfer residual toner is never collected by the magnetic brush are present on the surface of the photosensitive member, thereby causing the transfer residual toner to be left as lines on the surface of the photosensitive member. These portions pass through the latent image forming area to form a white-line image.

Also, when the weight percent of the carrier particles 247*a* having a small particle diameter is equal to or larger than 80 weight percent, the number of white dots is equal to or larger than 20, thereby significantly degrading the image. A possible reason for this is as follows. With an increase in the ratio of the carrier particles having a small particle diameter, the magnetic brush tends to be formed only with such carrier particles having a small particle diameter. At the tip of the magnetic brush formed only with such carrier particles having a small particle diameter, a magnetic attraction to the magnetic roller 241 is small. Therefore, the tip of the magnetic brush is removed by sliding with the surface of the photosensitive member or by adhering to the transfer residual toner on the surface of the photosensitive member, thereby being attached to the surface of the photosensitive member. As a result, an unexposed portion is formed at the carrier attached to the surface of the photosensitive member, thereby increasing the average number of white dots.

On the other hand, when the weight percent of the carrier particles having a large particle diameter was 40 to 80 weight percent, the average number of white dots is smaller than 10, and a satisfactory image Was obtained. In the magnetic brush formed with the weight percent mentioned above, the large carrier particles are each attached with and surrounded by the small carrier particles. These carrier particles having a small particle diameter slide in intimate contact with the surface of the photosensitive member to reliably retain the transfer residual toner. Also, with an increase in the number of times of contact of the magnetic brush and the surface of the photosensitive member, the transfer residual toner adhering to the photosensitive member can be reliably retained. Furthermore, with a magnetic force of the carrier particles having a large particle diameter, the carrier particles having a smaller particle diameter are reliably retained. Therefore, the carrier particles having a smaller particle diameter are prevented from being scattered to adhere to the surface of the photosensitive member. Consequently, it was possible to prevent an unexposed portion from being formed due to the attached carrier, and to obtain a satisfactory image with a small average number of white dots.

Next, by using the carrier used in the above experiment, the average number of white dots was observed as to a magnetic black toner and a non-magnetic black toner. As with the above, the average number of white dots were determined by printing five A4 sheets of a black solid image and visually observing the number of white dots. The magnetic toner can be obtained by adding any known magnetic fine powder, such as iron oxide, magnetite, and ferrite, to the toner. The magnetic toner for use was obtained by adding 15 to 45 weight percent of magnetic fine powder. The results are shown in Table 4.

TABLE 4

| NO. | WEIGHT PERCENTAGE OF 30 MICROMETERS | WEIGHT PERCENTAGE OF 80 MICROMETERS | NUMBER OF WHITE DOTS (PER A4 BLACK SOLID IMAGE WITH NON-MAGNETIC TONER) | NUMBER OF WHITE DOTS (PER A4 BLACK SOLID IMAGE WITH MAGNETIC TONER) | DECISION |
|---|---|---|---|---|---|
| 2 | 20 wt % | 80 wt % | 8.6 | 3.6 | ○ |
| 3 | 40 wt % | 60 wt % | 3.4 | 1.3 | ○ |
| 4 | 60 wt % | 40 wt % | 6.5 | 2.5 | ○ |

As evident from Table 4, if the magnetic toner is used, the average number of white dots can be reduced compared with the non-magnetic toner, thereby allowing a more satisfactory image to be obtained. A possible reason for this is that, by using the magnetic toner, with magnetism of the magnetic brush, the transfer residual toner can be reliably retained by the magnetic brush.

As described above, according to the fourth embodiment, the transfer residual toner that has not been electrostatically transferred by the primary transfer nip on the intermediate transfer belt 210 and remains on the surface of the photosensitive member 214 is temporarily retained by the magnetic brush of the toner retaining device 240 irrespectively of the polarity of the toner. When passing through the latent image forming area, the transfer residual toner is returned from the retaining device 240 to the surface of the photosensitive member at a timing such as that when the exposing device 204 does not perform writing on the surface of the photosensitive member. Then, while no latent image is being formed, the transfer residual toner passes through the latent image area to be collected by the developing device. With this, the transfer residual toner is prevented from adhering to the surface of the photosensitive member passing through the latent image forming area while the exposing device 204 is forming a latent image. Thus, an unexposed portion is prevented from being formed due to the transfer residual toner, and the transfer residual toner can be collected by the developing device. As a result, white dots can be prevented from occurring on a solid image portion, thereby allowing a satisfactory image to be obtained.

Also, in the magnetic brush, the carrier particles having a large average particle diameter of 70 to 100 micrometers are each attached with and surrounded by the carrier particles having a small average particle diameter of 20 to 50 micrometers. These carrier particles having a small particle diameter slide in intimate contact with the surface of the photosensitive member to reliably retain the transfer residual toner adhering to the photosensitive member. Also, with an increase in the number of times of contact between the magnetic brush and the transfer residual toner, it is possible to increase the amount of negative charge on the transfer residual toner by friction with the magnetic brush and also to reverse the polarity in a manner such that a reversely-charged toner is changed to a normally-charged toner. As a result, the transfer residual toner returned to the surface of the photosensitive member at the timing described above is a normally-charged toner having the same polarity as that of the charging bias, and can therefore pass through the charging roller 203*a* without being electrostatically absorbed in the charging roller 203*a*. Furthermore, with a magnetic force of the carrier particles having a large particle diameter, the carrier particles having a smaller particle diameter can be reliably retained. Therefore, the carrier particles having a smaller particle diameter at the tip of the magnetic brush are prevented from being removed by an electrostatic force of the transfer residual toner on the photosensitive member or sliding with the photosensitive member to be attached to the surface of the photosensitive member. Consequently, it is possible to prevent an unexposed portion from being formed due to the transfer residual toner or the removed carrier, and to prevent white dots from occurring on a solid image portion, thereby allowing a satisfactory image to be obtained.

Furthermore, when the carrier particles having a large particle diameter is 40 weight percent, the ratio of the carrier particles having a small particle diameter of 20 to 50 micrometers is increased, thereby increasing a ratio of forming the magnetic brush only with the carrier particles having a small particle diameter. The carrier at the tip of the magnetic brush formed only with the carrier particles having a small particle diameter has a weak magnetic binding force. Therefore, the carrier particles having a small particle diameter at the tip of the magnetic brush are removed by an electrostatic force of the transfer residual toner or sliding with the photosensitive member to be attached to the surface of the photosensitive member. As a result, an unexposed portion is formed due to the removed carrier, and white dots occur on a solid image portion. On the other hand, when the carrier particles having a large average particle diameter of 70 to 100 micrometers is larger than 80 weight percent, the amount of the carrier particles having a small particle diameter surrounding and adhering to the carrier particles having a large particle is decreased. With that, the magnetic brush cannot slide in intimate contact with the surface of the photosensitive member, and therefore the transfer residual toner adhering to the photosensitive member cannot be reliably retained by the magnetic brush. As a result, an unexposed portion is formed due to the transfer residual toner, and white dots occur on a solid image portion. Therefore, of the carrier forming the magnetic brush, with the carrier particles having a large average particle diameter of 70 to 100 micrometers being 40 to 80 weight percent, the transfer residual toner can be reliably retained. Also, the small carrier particles are prevented from being removed by an electrostatic force of the transfer residual toner or sliding with the photosensitive member to be attached to the surface of the photosensitive member. Consequently, it is possible to prevent an unexposed portion from being formed due to the transfer residual toner or the removed carrier, and to prevent white dots from occurring on a solid image portion, thereby allowing a satisfactory image to be obtained.

Still further, by using a magnetic toner, with the magnetic force of the magnetic brush, the transfer residual toner can be reliably retained by the magnetic brush. Therefore, an unexposed portion is further prevented from being formed due to the transfer residual toner. As a result, white dots can be further prevented from occurring on a solid image portion, thereby allowing a satisfactory image to be obtained.

Still further, in the fourth embodiment, while the exposing device 204 is in operation, a retaining bias having a potential approximately equal to the surface potential of the photosensitive member after transfer is applied by the first power supply 243. With this, no potential difference occurs between the magnetic brush and the surface of the photosensitive member. Therefore, the normally-charged toner having a negative potential and the reversely-charged toner having a positive potential are prevented from being electrostatically absorbed in the surface of the photosensitive member. As a result, the transfer residual toner can be reliably retained by a friction force of the magnetic brush. Thus, the transfer residual toner is prevented from adhering to the surface of the photosensitive member passing through the latent image forming area while the exposing device 204 is forming a latent image. Then, while the exposing device 204 is not in operation, that is, while no image is being formed, the switch 245 serving as a selecting unit is switched from the first power supply 243 to the second power supply 244. With this, the magnetic brush is applied with an emission bias having a minus polarity, which is the same as that of the surface of the photosensitive member after transfer, and having a potential (350 volts) larger than an absolute value (50 volts) of the surface potential of the photosensitive member after transfer. Then, a potential difference occurs between the surface of the photosensitive member and the magnetic brush. The transfer residual toner retained by the magnetic brush has been charged by friction with the magnetic brush to uniformly become a normally-charged toner. Therefore, the transfer residual toner retained by the magnetic brush is emitted from the magnetic brush to be electrostatically absorbed in the surface of the photosensitive member, which has a high potential. With this, the transfer residual toner at the magnetic brush can be returned to the surface of the photosensitive member. As such, with the transfer residual toner retained by the retaining device 240 being returned to the surface of the photosensitive member while no image is being formed, the transfer residual toner can pass through the latent image forming area while the exposing device 204 is not in operation.

Still further, in the fourth embodiment, during an image forming process, the transfer residual toner is retained by the retaining device 240 so as not to pass through the latent image forming area. Then, while no latent image is being formed, the transfer residual toner passes through the latent image area to be collected by the developing device. With this, an unexposed portion is prevented from being formed due to the transfer residual toner, and the transfer residual toner can be collected by the developing device. As a result, white dots can be prevented from occurring on a solid image portion, thereby allowing a satisfactory image to be obtained.

Still further, in the fourth embodiment, the rotating sleeve 241*a* rotates in the same rotating direction as that of the photosensitive member 214. With this, at the position where the rotating sleeve 241 and the photosensitive member 214 are opposed to each other, the surface of the rotating sleeve 241*a* moves in a direction in reverse to the moving direction of the surface of the photosensitive member. As a result, a large number of tips of the magnetic brush are in contact with the surface of the photosensitive member while the photosensitive member passes through the retaining nip. Therefore, the transfer residual toner retained on the surface of the photosensitive member can be reliably retained. Also, with an increase in the number of times of contact between the magnetic brush and the transfer residual toner, the transfer residual toner is further charged by friction. Therefore, it is possible to reliably reverse the polarity in a manner such that a reversely-charged toner is changed to a normally-charged toner.

Still further, compared with the case where the magnetic brush roller 241 goes along the surface of the photosensitive member 214 and the case where the magnetic brush roller 241 is driven in the same direction as that of the surface of the photosensitive drum 214, the present embodiment can achieve an operation of more scraping the additive of the toner adhering to the surface of the photosensitive member 214. Consequently, the occurrence of a filming phenomenon can be prevented.

Still further, with the components being formed in a process cartridge, if any component incorporated in the process cartridge 230 reaches its end of life or requires maintenance, all what is required is to replace the process cartridge 230. This improves convenience.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A cleaning system for collecting a residual toner that remains on a surface of a latent image carrier after transferring, to a surface moving member, a toner image that is formed by uniformly charging the surface of the latent image carrier by a charging unit, by forming a latent image by a latent image forming unit on the surface of the latent image carrier, and by developing the latent image to a toner image by a developing unit, the cleaning system comprising:

a temporarily-retaining unit that includes a magnetic field generating unit fixedly disposed inside a rotating member, the rotating member spaced apart from the latent image carrier and configured to carry a magnetic particle as a magnetic brush on a surface of the rotating member, the temporarily-retaining unit temporarily and mechanically retains the residual toner abutting on the latent image carrier while the residual toner travels from a transferring unit to the latent image forming unit;

a bias applying unit including a first power supply and a second power supply, the bias applying unit selectively applies a retaining bias with the first power supply and applies an emission bias with the second power supply to the magnetic brush of the temporarily-retaining unit; and a controlling unit that at a predetermined timing controls to return the residual toner retained by the temporarily-retaining unit to the surface of the latent image carrier, wherein the rotating member is rotated at a faster velocity than the latent image carrier, and wherein the retaining bias has a potential equivalent to a potential of the surface of the latent image carrier after passing through the transferring unit, the emission bias has a same polarity as a polarity of the potential of the surface of the latent image carrier after passing through the transferring unit, and has an absolute value that is larger than an absolute value of the potential of the surface of the latent image carrier after passing through the transferring unit.

2. The cleaning system according to claim 1, wherein the controlling unit controls such that the bias applying unit selects the emission bias when no image is being formed.

3. The cleaning system according to claim 1, wherein the temporarily-retaining unit includes a driving unit that rotates the rotating member in a direction identical to a direction in which the latent image carrier rotates.

4. A cleaning system for collecting a residual toner that remains on a surface of a latent image carrier after transferring, to a surface moving member, a toner image that is formed by uniformly charging the surface of the latent image carrier by a charging unit, by forming a latent image by a latent image forming unit on the surface of the latent image carrier, and by developing the latent image to a toner image by a developing unit, the cleaning system comprising:

a temporarily-retaining unit that includes a magnetic field generating unit fixedly disposed inside a rotating member, the rotating member spaced apart from the latent image carrier and configured to carry a plurality of types of magnetic particles having different distribution of a particle diameter as a magnetic brush on a surface of the rotating member, the temporarily-retaining unit temporarily retains the residual toner with the magnetic brush by sliding the magnetic brush keeping a contact with the surface of the latent image carrier while the residual toner travels from a transferring unit to the charging unit;

selectively applying a retaining bias with a first power supply of a bias applying unit and applying an emission bias with a second power supply of the bias applying unit to the magnetic brush of the temporarily-retaining unit; and a controlling unit that at a predetermined timing controls to return the residual toner retained by the temporarily-retaining unit to the surface of the latent image carrier, wherein the rotating member is rotated at a faster velocity than the latent image carrier, and wherein the retaining bias has a potential equivalent to a potential of the surface of the latent image carrier after passing through the transferring unit, the emission bias has a same polarity as a polarity of the potential of the surface of the latent image carrier after passing through the transferring unit, and has an absolute value that is larger than an absolute value of the potential of the surface of the latent image carrier after passing through the transferring unit.

5. The cleaning system according to claim 4, wherein the magnetic particles include a magnetic particle having an average particle diameter that is equal to or larger than 70 micrometers and equal to or smaller than 100 micrometers, and a magnetic particle having an average particle diameter that is equal to or larger than 20 micrometers and equal to or smaller than 50 micrometers, and the magnetic particle having the average particle diameter that is equal to or larger than 70 micrometers and equal to or smaller than 100 micrometers is included as much as 40 weight percent or more and 80 weight percent or less.

6. The cleaning system according to claim 4, wherein a toner that includes the residual toner is a magnetic toner.

7. The cleaning system according to claim 4, wherein the controlling unit controls such that the bias applying unit selects the emission bias when no image is being formed.

8. The cleaning system according to claim 4, wherein the temporarily-retaining unit includes a driving unit that rotates the rotating member in a direction identical to a direction in which the latent image carrier rotates.

9. The cleaning system according to claim 1, wherein the rotating member is rotated 1.5 to 2.0 times faster than the latent image carrier.

10. The cleaning system according to claim 4, wherein the rotating member is rotated 1.5 to 2.0 times faster than the latent image carrier.

11. The cleaning system according to claim 1, wherein the bias applying unit includes a switch to switch between the first power supply and the second power supply, and wherein the switch is switched to the second power supply during a cleaning mode.

12. The cleaning system according to claim 4, wherein the bias applying unit includes a switch to switch between the first power supply and the second power supply, and wherein the switch is switched to the second power supply during a cleaning mode.

* * * * *